US005092733A

United States Patent [19]

Kishi

[11] Patent Number: 5,092,733

[45] Date of Patent: Mar. 3, 1992

[54] TOOL CONTROLLING MECHANISMS FOR EXCAVATOR WITH TELESCOPIC ARM

[75] Inventor: Mitsuhiro Kishi, Tochigi, Japan

[73] Assignee: Kabushiki Kaisha Hikoma Seisakusho, Tochigi, Japan

[21] Appl. No.: 506,690

[22] Filed: Apr. 9, 1990

[30] Foreign Application Priority Data

Apr. 26, 1989 [JP] Japan ..... 1-107990
May 18, 1989 [JP] Japan ..... 1-125443
Sep. 22, 1989 [JP] Japan ..... 1-247005

[51] Int. Cl.[5] ..... B66C 23/00

[52] U.S. Cl. ..... 414/718; 414/912; 414/694; 52/118; 212/268

[58] Field of Search ..... 414/718, 728, 547, 912, 414/685, 680, 695.5, 687, 694; 212/267, 268, 269; 52/118

[56] References Cited

U.S. PATENT DOCUMENTS 3,245,559 4/1966 Russell ..... 414/718 X
3,390,794 7/1968 McMullen et al. ..... 414/718 X
3,624,785 11/1971 Wilson ..... 414/718 X
3,688,930 9/1972 Shumaker ..... 414/718
3,836,025 9/1974 Olson et al. ..... 414/547
3,874,532 4/1975 Metailler ..... 414/912 X
4,274,797 6/1981 Coon ..... 414/718 X
4,293,270 10/1981 Prime ..... 414/718
4,523,684 6/1985 Baisden ..... 414/912 X
4,699,562 10/1987 Crook et al. ..... 414/718
4,793,765 12/1988 Paul et al. ..... 414/718

*Primary Examiner*—Frank E. Werner
*Assistant Examiner*—James T. Eller, Jr.
*Attorney, Agent, or Firm*—Flynn, Thiel, Boutell & Tanis

[57] ABSTRACT

An excavator comprising a movable body, a boom mounted on the movable body, first hydraulic cylinders, an outer arm pivotally mounted on the boom, a second hydraulic cylinder mounted on a rear surface of the boom, an inner arm inserted into the outer arm and movable telescopically relative to the outer arm, a bucket connected to one end of the inner arm, a bucket connected to the tip end of the inner arm, a bucket cylinder provided between the bucket and a guide mechanism, the guide mechanism being slidably mounted on guide plates fixed to the outer arm, a third hydraulic cylinder connected to a base end of the outer arm and having a rod connected to a central portion of the inner arm for moving the inner arm relative to the outer arm, and a synchronizing device for moving the base end of the outer arm for a length corresponding to the distance the inner arm moves relative to the outer arm. A hook mechanism can be mounted at a front portion of the inner arm. An interlocking device can be connected between the guide mechanism and the front portion of the inner arm.

8 Claims, 24 Drawing Sheets

TOOL CONTROLLING MECHANISMS FOR EXCAVATOR WITH TELESCOPIC ARM

BACKGROUND OF THE INVENTION

1. Field of the Invention

The present invention relates to an excavator, particularly to an excavator provided with arms which are telescopically stretchable in the longitudinal direction thereof and a bucket for digging and removing earth and sand. A modified excavator is provided with a hook at the tip end of the arm.

2. Description of Prior Art

There has been widely used an excavator in an area where earth working, such as digging trenches or holes, is carried out (hereinafter referred to as the working area), which excavator comprises a boom having a slightly C-shaped configuration and swingably mounted on a movable body, an arm connected to the tip end of the boom and having a substantially linear shape so as to be vertically movable relative to the boom and a bucket mounted at the tip end of the arm. An excavator called a back hoe has been used widely in road construction or for burying objects. The boom, the arm and the bucket cooperate so that the bucket is pushed into the earth to dig the earth and sand and is raised to remove the dug earth and sand. A fundamental arrangement of the excavator is principally the same, namely, it includes three hydraulic cylinders cooperating with each other for carrying out the digging operation.

However, the conventional excavator has the following drawbacks.

A first drawback is that the length of the boom and the length of the arm are respectively to be extended to deepen the trench and the hole. Furthermore, when the earth and sand are picked and collected by the excavator at a river side, inasmuch as the lengths of the boom and the arm are fixed, the bucket can not reach beyond a predetermined length, the depth of digging and the length to reach the earth and sand are limited. It is theoretically possible to extend the lengths of the boom and the arm to dig deeper or to permit the bucket to reach a longer distance. However, if the lengths of the bucket and the arm are extended, the excavator becomes long as a whole which entails difficult transportation. In this case, if the boom is positioned perpendicularly relative to the mobile body so as to turn the bucket after collecting the earth and sand, the length of the boom becomes so long that it is liable to contact an electric wire or a construction structure.

That is, the first drawback is that it was impossible to lengthen the distance that the bucket extends from the movable body since the lengths of the boom and the arm are fixed and the connecting portions between the movable body, the boom, the arm and the bucket are merely operated at joints thereof. Hence, when the earth and sand is to be dug deeply, a long boom is necessitated, which is very inconvenient.

A second drawback is as follows. The conventional excavator has a function to dig deeply, which is very effective for mechanically digging a large volume of earth and sand and very improved in the working efficiency compared with man power. However, at the working area digging working is usually accompanied by burying working for burying pipes, including a Hume concrete pipe, to return to the original position or covering working for covering the dug trench or the hole by an iron plate. There is no problem to raise or lower materials having a weight that can be handled by man power. However, in the case of heavy materials, such as the Hume concrete pipe or the iron plate, there is required an exclusive raising and lowering means, such as a crane, from the safety point of view. The crane meets the requirement of a safe standard of working.

It has been very rare to employ a working step that requires a crane in the working area in addition to an excavator. Furthermore, there seldom occurs the case that two vehicles having different functions occupy the same working area. When the working area comprises a main working area and a neighboring area, such as narrow side roads surrounding the main working area from which the excavator enters, only the excavator enters the working area for thereby preventing the crane from entering the working area. Still furthermore, since the operating hours of the crane are so short compared with those of the excavator, there is caused idle time for the crane even if it occupies the working area.

In the case of raising the heavy material during the operation of digging the earth and sand, a wire is hung from the bucket of the excavator and the heavy material is suspended by the wire, thereafter the boom supporting the bucket is vertically moved to raise the heavy material. Although the operation to raise the heavy material is very simple, there is a likelihood that the wire will slip from the bucket since the excavator has no function inherently to raise the heavy material. This use of the excavator, which is different from the inherent use, as a crane, is involved in a dangerous working operation since the weight limit of the material to be suspended by the bucket is unknown.

In view of the inconvenience of the excavator, the applicant proposed an excavator, as disclosed in Japanese Patent Application No. 63-315787, having a crane incorporated in an excavator. The excavator having the contractible crane mechanism which is provided at the side of the arm or accommodated inside the arm is so structured that the crane is stretched from the arm when raising the heavy material and a wire is hung down from the tip end of the crane mechanism, then a hook is hung down from the tip end of the wire. With this arrangement, when the heavy material is not raised, the crane mechanism is contracted so as not to obstruct the digging operation by the bucket. Hence, this excavator is very convenient to use in a narrow working area since it carries out two functions by a single unit, namely, the function to raise the material and the function to dig the earth and sand.

The proposed excavator having the crane function has, however, the drawback that the crane mechanism is to be contracted so as not to hinder the digging operation and this entails a complicated mechanism. Furthermore, the crane mechanism is separately provided in addition to the arm and the boom which requires many manufacturing steps and high cost.

To solve the first drawback, the applicant proposed an excavator provided with telescopically stretchable arms and a bucket attached to a distal end of the arms. One of the arms can be lowered to the deepest position in the working area or extended to a longest position in the working area as disclosed in Japanese Patent Application No. 1-107990. However, a hydraulic cylinder for controlling the angular distance or position of the bucket relative to the arm is moved simultaneously with the movement of the inner arm relative to the outer arm. Hence, the hydraulic cylinder is so designed that a part of the hydraulic cylinder is movable relative to the outer arm and a base of the hydraulic cylinder is moved by the front or the rear wire in synchronism with the movement of the inner arm. However, this proposed excavator has such a drawback that the base of the hydraulic cylinder is not movable in synchronism with the inner arm since the front and the rear wires are all the time stretched, which entails a complicated mechanism.

SUMMARY OF THE INVENTION

To solve the first drawback of the conventional excavator, an excavator according to a first aspect of the present invention comprises a movable body, a boom mounted at one end thereof on a front portion of the movable body, first hydraulic cylinders mounted at one end thereof on the front portion of the movable body, the first hydraulic cylinders being provided with piston rods connected at the tip ends thereof with substantially the central portion of the boom for moving the boom swingably in the longitudinal direction thereof, an outer arm pivotally swingably mounted on the other end of the boom, a second hydraulic cylinder mounted on a rear surface of the boom, the second hydraulic cylinder being provided with a piston rod connected to a rear portion of the outer arm for correcting an angular distance between the boom and the outer arm, an inner arm inserted into the outer arm and movable telescopically relative to the outer arm in the longitudinal direction of the outer arm, a bucket connected to the tip end of the inner arm, a bucket cylinder provided with a piston rod and having one end connected to the bucket, a guide mechanism slidably mounted on guide plates fixed to the outer arm and connected to the rear end of the bucket cylinder for operating the bucket cylinder to thereby stretch the piston rod from the bucket cylinder so that the angular distance between the bucket and the inner arm is kept unchanged with synchronism with the amount of movement of the inner arm, a third hydraulic cylinder connected to a base end of the outer arm at the base thereof and having a rod connected to a central portion of the inner arm for moving the inner arm relative to the outer arm, and a synchronous means for moving the base end of the outer arm for the length corresponding to the telescopical stretchable length of the inner arm.

To solve the second drawback of the conventional excavator, an excavator according to a second aspect of the present invention comprises a movable body, a boom mounted at one end thereof on a front portion of the movable body, first hydraulic cylinders mounted at one end thereof on the front portion of the movable body, the first hydraulic cylinders being provided with piston rods connected at the tip ends thereof with substantially the central portion of the boom for moving the boom swingably in the longitudinal direction thereof, an outer arm pivotally swingably mounted on the other end of the boom, a second hydraulic cylinder mounted on a rear surface of the boom, the second hydraulic cylinder being provided with a piston rod connected to a rear portion of the outer arm for correcting an angular distance between the boom and the outer arm, an inner arm inserted into the outer arm and movable telescopically relative to the outer arm in the longitudinal direction of the outer arm, a bucket connected to the tip end of the inner arm, a bucket cylinder provided with a piston rod and having one end connected to the bucket, a guide mechanism slidably mounted on guide plates fixed to the outer arm and connected to the rear end of the bucket cylinder for operating the bucket cylinder to thereby stretch the piston rod from the bucket cylinder so that the angular distance between the bucket and the inner arm is kept unchanged with synchronism with the amount of movement of the inner arm, a third hydraulic cylinder connected to a base end of the outer arm at the base thereof and having a rod connected to a central portion of the inner arm for moving the inner arm relative to the outer arm, a synchronous means for moving the base end of the outer arm for the length corresponding to the telescopical stretchable length of the inner arm and a hook mechanism mounted at a front portion of the inner arm.

To solve the third drawback of the conventional excavator, an excavator according to a third aspect of the present invention comprises a movable body, a boom mounted at one end thereof on a front portion of the movable body, first hydraulic cylinders mounted at one end thereof on the front portion of the movable body, the first hydraulic cylinders being provided with piston rods connected at the tip ends thereof with substantially the central portion of the boom for moving the boom swingably in the longitudinal direction thereof, an outer arm pivotally swingably mounted on the other end of the boom, a second hydraulic cylinder mounted on a rear surface of the boom, the second hydraulic cylinder being provided with a piston rod connected to a rear portion of the outer arm for correcting an angular distance between the boom and the outer arm, an inner arm inserted into the outer arm and movable telescopically relative to the outer arm in the longitudinal direction of the outer arm, a bucket connected to the tip end of the inner arm, a bucket cylinder provided with a piston rod and having one end connected to the bucket, a guide mechanism slidably mounted on guide plates fixed to the outer arm and connected to the rear end of the bucket cylinder for operating the bucket cylinder to thereby stretch the piston rod from the bucket cylinder so that the angular distance between the bucket and the inner arm is kept unchanged with synchronism with the amount of movement of the inner arm, a third hydraulic cylinder connected to a base end of the outer arm at the base thereof and having a rod connected to a central portion of the inner arm for moving the inner arm relative to the outer arm, a synchronous means for moving the base end of the outer arm for the length corresponding to the telescopical stretchable length of the inner arm, and interlocking means connected between the guide mechanism and the front portion of the inner arm.

The above and other objects, features and advantages of the present invention will become more apparent from the following description taken in conjunction with the accompanying drawings.

DESCRIPTION OF THE PREFERRED EMBODIMENT

First Embodiment (FIGS. 1 to 5)

Figure 1:
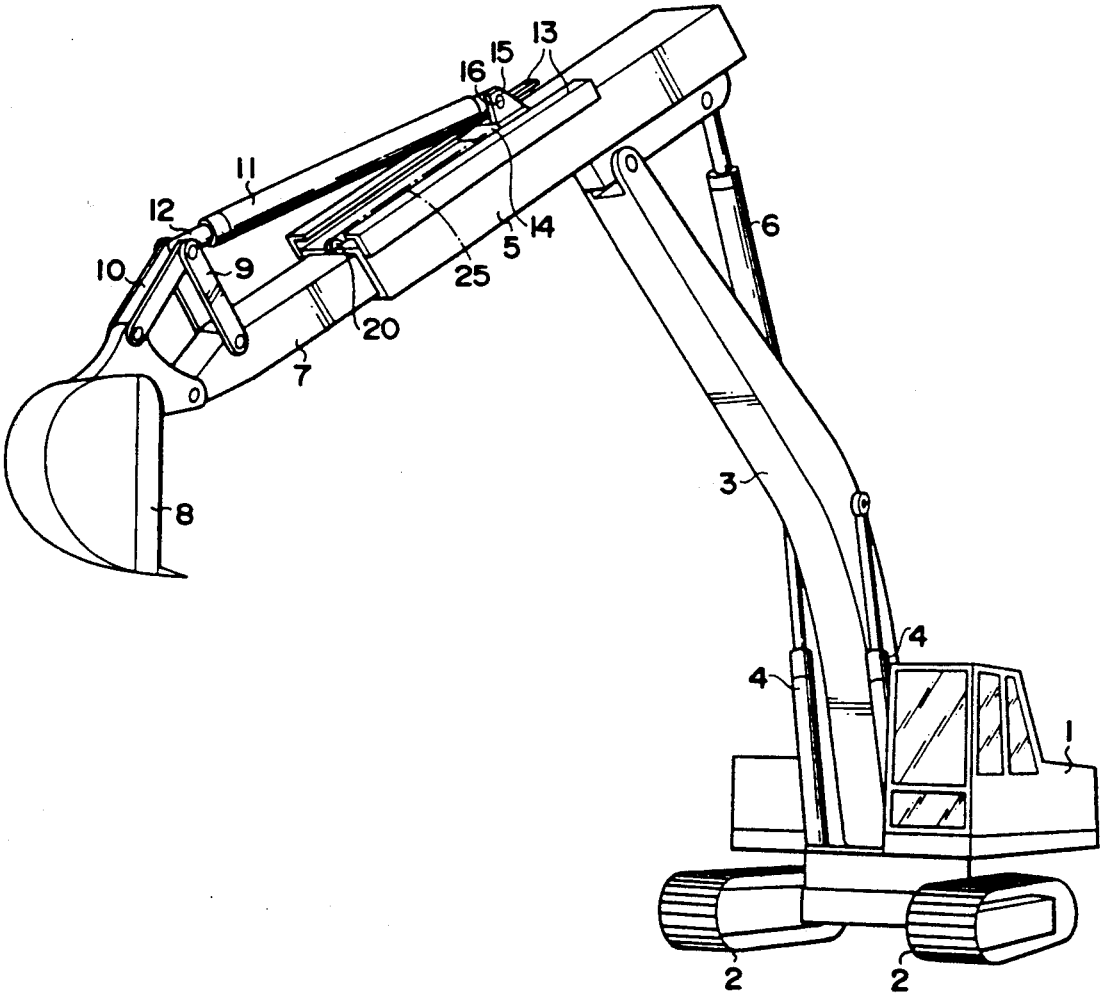
FIG. 1 is a perspective view of an excavator according to a first embodiment of the present invention.

An excavator according to a first embodiment will be described with reference to FIGS. 1 to 5.

The excavator comprises a movable body 1, a boom 3 mounted at one end thereof on a front portion of the movable body 1, first hydraulic cylinders 4 mounted at corresponding first ends thereof on the front portion of the movable body 1, the first hydraulic cylinders being provided with piston rods connected at the tip ends thereof with substantially the central portion of the boom 3 for moving the boom 3 vertically swingably in the longitudinal direction thereof, an outer arm 5 pivotally swingably mounted on the other end of the boom 3, a second hydraulic cylinder 6 mounted on the rear surface of the boom 3, the second hydraulic cylinder 6 being provided with a piston rod connected to the rear portion of the outer arm 5 for correcting an angular distance between the boom 3 and the outer arm 5, an inner arm 7 inserted into the outer arm 5 and movable telescopically relative to the outer arm 5 in the longitudinal direction of the outer arm 5, a bucket 8 connected to the tip end of the inner arm 7, a bucket cylinder 11 provided with a piston rod 12 and having one end connected to the bucket 8, a guide mechanism 14 slidably mounted on guide plates 13 fixed to the outer arm 5 and connected to the rear end of the bucket cylinder for operating the bucket cylinder to thereby stretch the piston rod 12 from the bucket cylinder 11 so that the angular distance between the bucket 8 and the inner arm 7 is kept unchanged in synchronism with the amount of movement of the inner arm 7, a third hydraulic cylinder 17 connected to a base end of the outer arm 5 at the base thereof and having a rod 18 connected to a central portion of the inner arm 7 for moving the inner arm 7 relative to the outer arm 5, and a synchronous means for moving the base end of the outer arm 5 for the length corresponding to the telescopical stretchable length of the inner arm 7.

The excavator will be described more in detail. The body 1 accommodates thereon hydraulic generator, etc., and a pair of crawlers 2 are provided under the body 1 at the right and left sides thereof so that the body 1 is movable by the pair of crawlers.

The boom 3 is pivotally mounted on the front of the body 1 at one end thereof and is curved slightly at the central portion thereof. The first hydraulic cylinders 4 having piston rods are mounted on the front of the body 1 at respective one ends thereof and are positioned to support the boom 3 and are connected to the boom 3 by the piston rods at the central portion thereof for moving the boom 3 angularly relative to the body 1.

The linear outer arm 5 is swingably mounted at the other end of the boom 3. The second hydraulic cylinder 6 is interposed between the rear portion of the outer arm 5 and the rear surface of the boom 3 for changing the angle between the outer arm 5 and the boom 3. The outer arm 5 is made of a steel plate, is hollow and is square in cross section. The inner arm 7 having the same shape as the outer arm 5 is inserted in the outer arm 5 so as to be slidable inside the outer arm. The bucket 8 is swingably mounted on the tip end of the inner arm 7. Levers 9, 10 are attached to the tip end of the inner arm 7 and the rear portion of the bucket 8, respectively, for forming a linkage mechanism. The levers 9, 10 are connected with each other at the tip ends thereof for and form an angle having an apex to which the piston rod 12 of the bucket cylinder 11 is connected. The pair of guide plates 13 having respectively L-shaped configurations in cross section are fixed at the right and left corners of the upper surface of the outer arm 5. The slider 14 as the guide mechanism is inserted between the pair of guide plates 13 so as to be slidable along the longitudinal direction of the guide plates 13. A pair of trapezoidal shaft supporting plates 15 are fixed to the slider 14 with a predetermined spacing therebetween. The base of the bucket cylinder 11 is inserted between the pair of supporting plates 15 and is pivotally connected to the pair of supporting plates by 15 by a pin 16.

Figure 2:
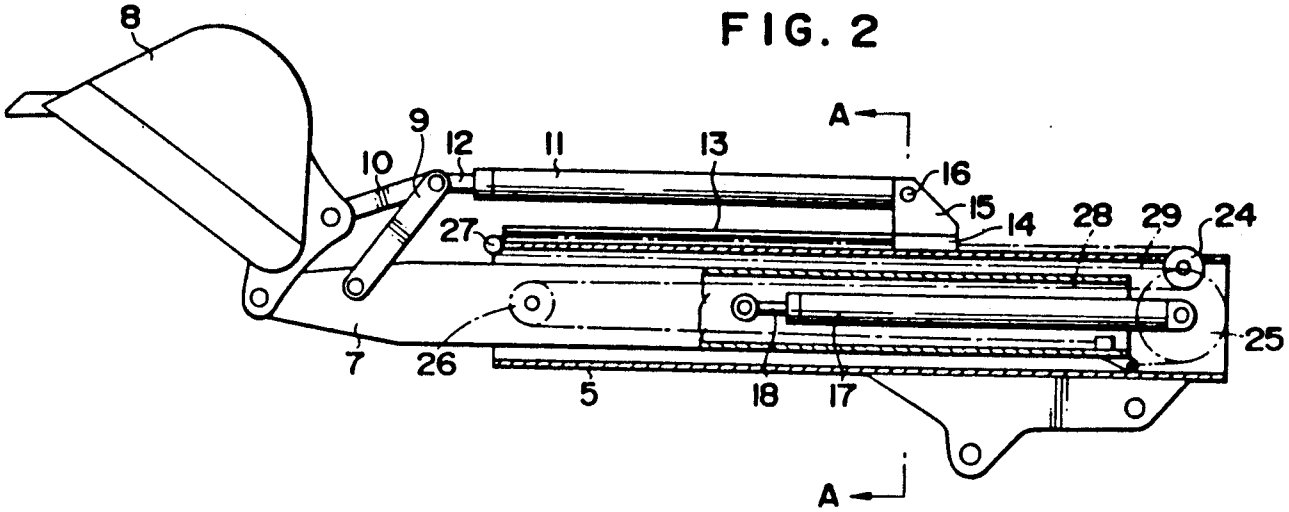
FIG. 2 is a cross sectional view showing an internal arrangement of an outer arm, a constituent of the excavator of FIG. 1.

In FIG. 2, the inner arm 7 has the third hydraulic cylinder 17 disposed in parallel with a longitudinal direction thereof for telescopically extending the inner arm 7. The third hydraulic cylinder 17 is fixed to the rear end of the outer arm 5 at the base portion thereof (right side in FIG. 2) and the piston rod 18 of the third hydraulic cylinder 17 is connected to the central portion of the inner arm 7. The outer arm 5 has a wheel 27 supported at the tip end thereof and a sprocket wheel 25 supported at the rear end thereof (right side in FIG. 2). The chain 29 is connected to the slider 14 at the tip end thereof and inverted at the wheel 27 and passes through a space between the outer arm 5 and the inner arm 7, and is further inverted at the sprocket wheel 25. The chain 29 is connected to the rear end of the inner arm 7 at the rear end thereof. The sprocket wheel 24 is supported at the rear end of the outer arm 5 with upper half portion thereof being exposed outside of and above the outer arm 5. The sprocket wheel 26 is held supported by the outer arm 5 inside the outer arm 5 and outside the inner arm 7. The chain 28 is connected to the slider 14, is inverted by the sprocket wheel 24 and passes through the space between the outer arm 5 and the inner arm 7 and extends in the direction of the bucket 8, and then is further inverted by the sprocket wheel 26. The chain 28 is connected to a rear portion of the inner arm 7 at the rear end thereof.

The operation of the excavator according to the first embodiment will be described hereinafter.

The crawlers 2 are driven to move the movable body 1 toward the place where the trenches and the holes are to be dug. The bucket 8 is positioned at the location where the earth and sand is to be dug and the first and the second hydraulic cylinders 4, 6 and the bucket cylinder 11 are operated in an interlocking manner to thereby turn the bucket 8 so that the bucket 8 can dig the earth and sand. The operation is the same as that of the conventional excavator.

Figure 3:
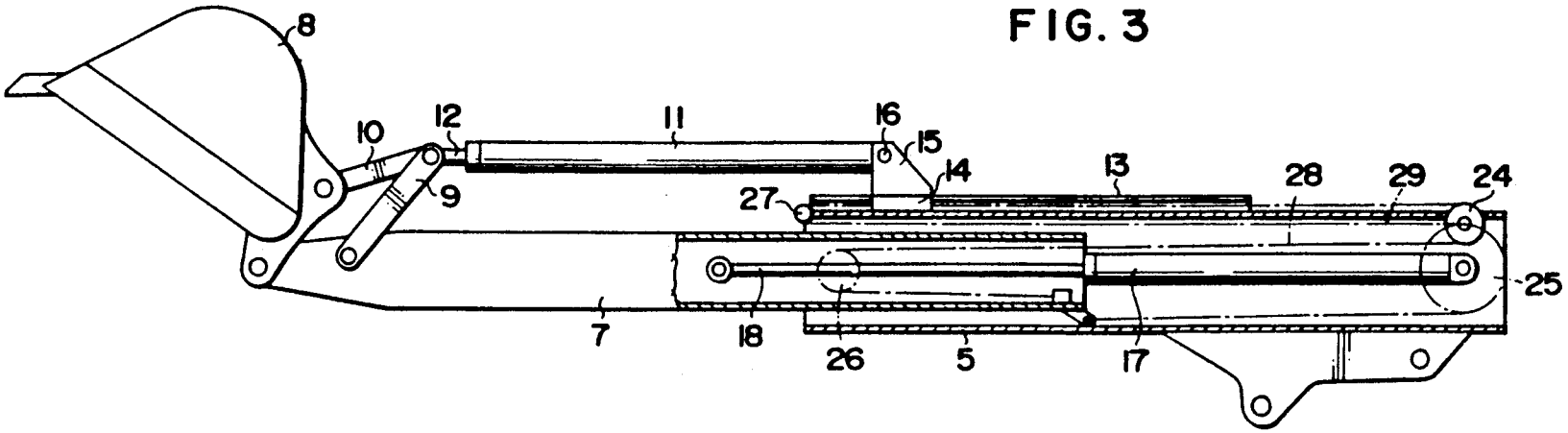
FIG. 3 is a cross sectional view of assistance in explaining a state where an inner arm, a constituent of the excavator of FIG. 1, is drawn out from the outer arm of FIG. 2.
Figure 4:
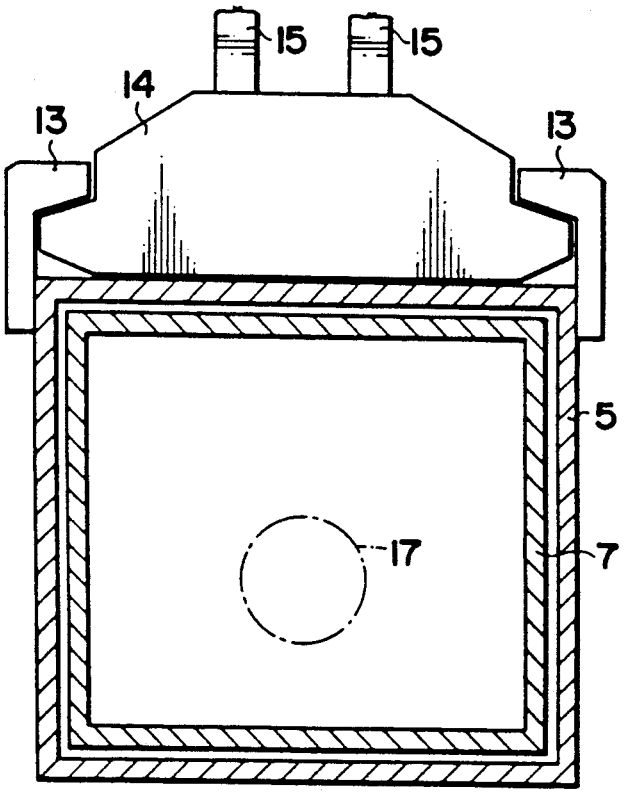
FIG. 4 is a cross sectional view taken along the section line A—A of FIG. 2.
Figure 5:
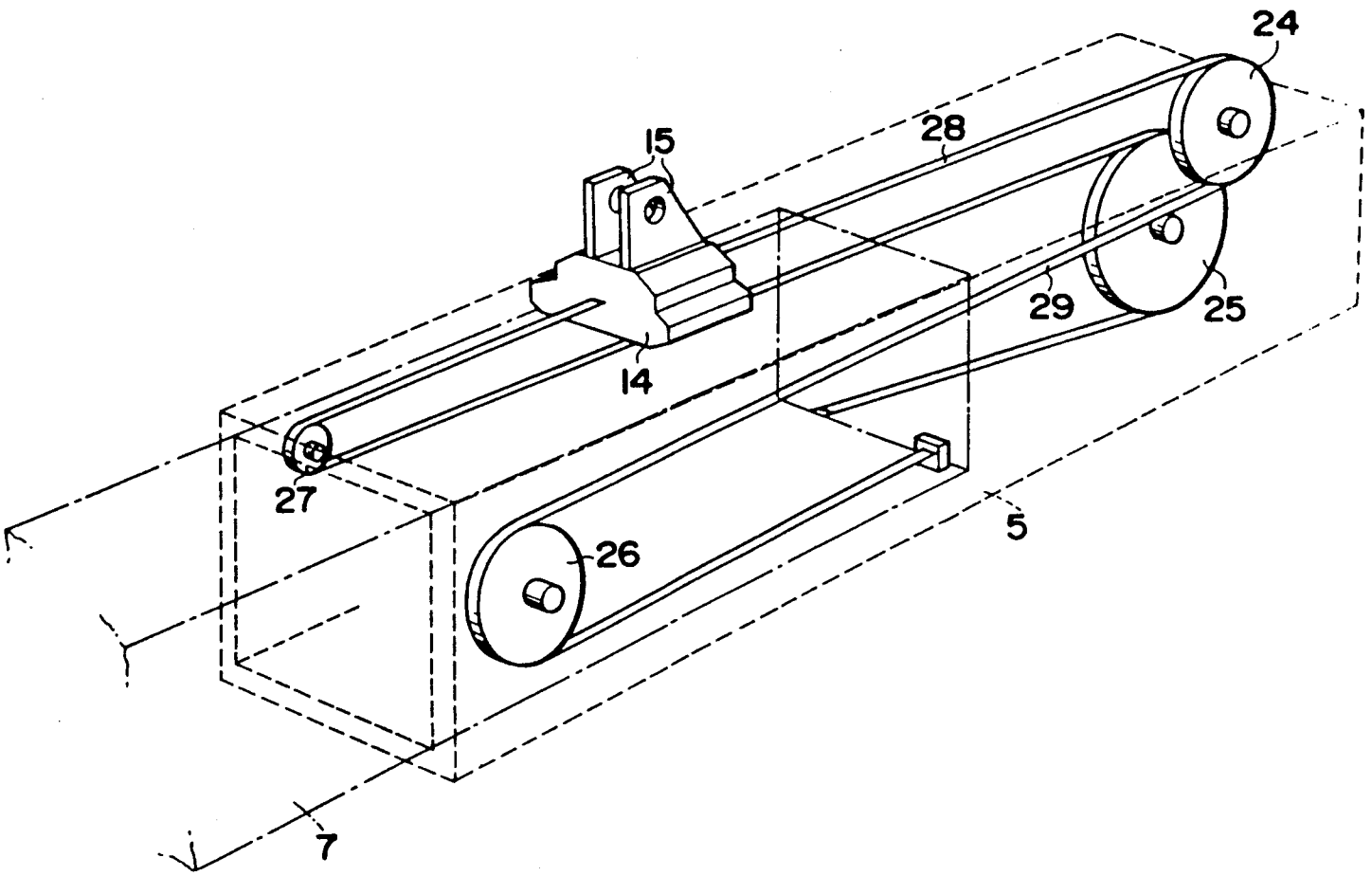
FIG. 5 is an exploded perspective view of assistance in explaining an arrangement of a synchronous mechanism, a constituent of the excavator of FIG. 1.

When the groove or the holes are to be deepened, the bucket 8 is controlled to be moved to the deeper position. At this time, the third hydraulic cylinder 17 receives the oil under pressure and pushes the piston rod 18 forwardly. The piston rod 18 is extended from the third hydraulic cylinder 17 for thereby pushing the inner arm 7 out of the outer arm 5, hence the inner arm 7 is slid from the position as illustrated in FIG. 2 to the position as illustrated in FIG. 3. Accordingly, the bucket 8 is moved to the position which is located farther from the base portion of the outer arm 5 so that the bucket 8 will reach the deepest position and dig the earth and sand therein.

At this time when the inner arm 7 is moved away from the outer arm 5, the chain 29 is inverted via the sprocket wheel 25 and inverted again by the wheel 27 so that the slider 14 may be moved forwardly toward an opening end direction of the outer arm 5. With the movement of the slider 14, both ends of the slider 14 are guided by and sliding contact with the guide plates 13 and the bucket cylinder 11 may be moved with the movement of the inner arm 7 for the synchronous amount of movement of the inner arm 7. When the third hydraulic cylinder 17 is operated to push the inner arm 7 out of the outer arm 5 due to extension of the piston rod 18, the bucket 8 is kept maintained at the same angular relationship relative to the movable body 1 since the bucket cylinder 11 is moved simultaneously with the extension of the piston rod 18 whereby the excavating operation can be made without difficulty.

When the earth and sand dug by the bucket 8 is raised, the third hydraulic cylinder 17 is first operated to pull the piston rod 18. The inner arm 7 is moved into the inner portion of the outer arm 5. Inasmuch as the chain 29 is connected to the rear portion of the inner arm 7, the chain 28 is stretched in the direction of the base of the outer arm 5 and inverted by the sprocket wheel 26 and further inverted by the sprocket wheel 24 for thereby moving the slider 14 in the direction of the base of the outer arm 5.

Accordingly, when the inner arm 7 is moved in the same manner set forth above, the bucket cylinder 11 is synchronized with the inner arm 7 and stretched for the same amount of movement whereby the bucket 8 is moved consequently while the angular distance of the bucket 8 relative to the movable body 1 is kept the same. Hence, the earth and sand so dug is not dropped from the bucket 8. Thereafter, the first and the second hydraulic cylinders 4, 6 and the bucket cylinder 11 are interlocked with each other so that the earth and sand dug by the bucket 8 is loaded on a truck which is standing by at the rear side of the movable body 1 or moved and shifted to another portion.

Figure 6:
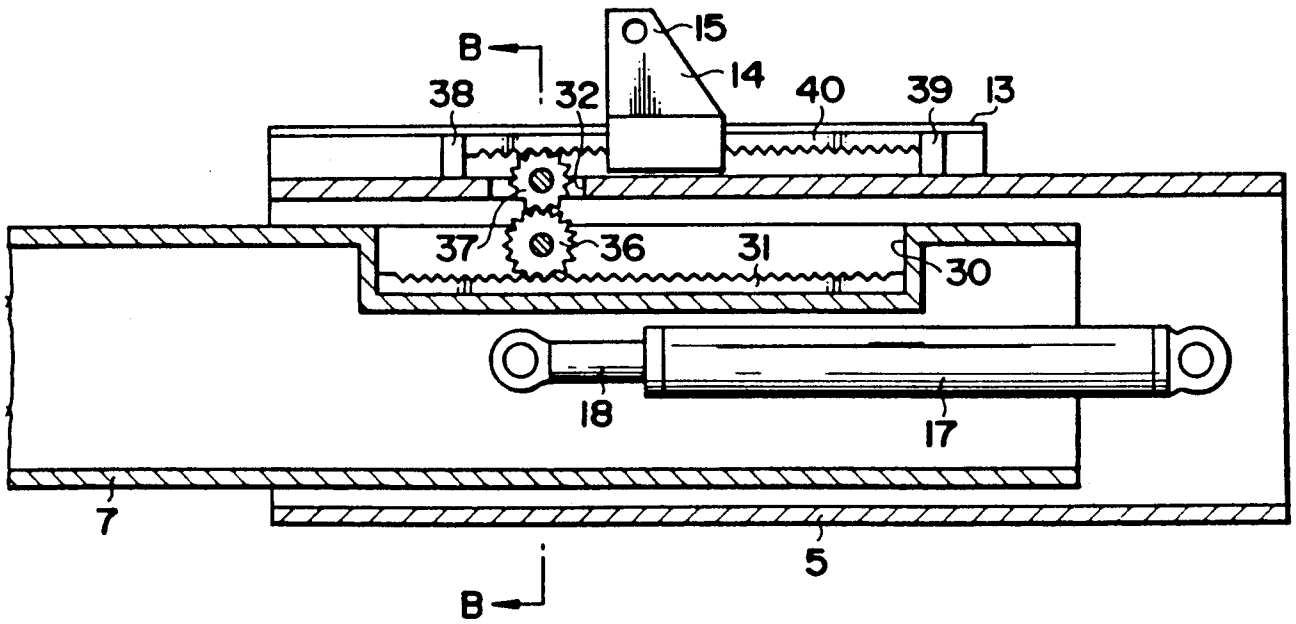
FIG. 6 is a side cross sectional view showing an internal arrangement of an outer arm employed in an excavator according to a second embodiment of the present invention.
Figure 7:
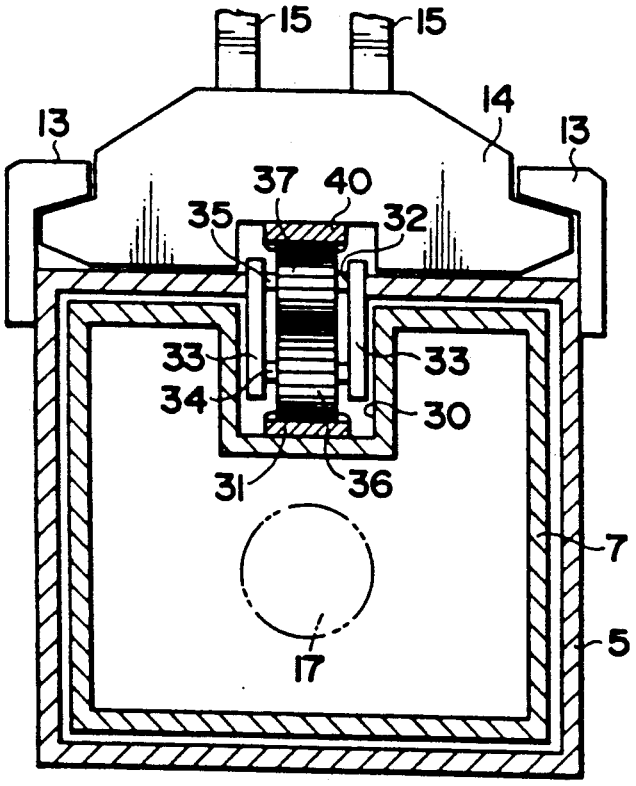
FIG. 7 is a cross sectional view taken along the section line B—B of FIG. 6.
Figure 8:
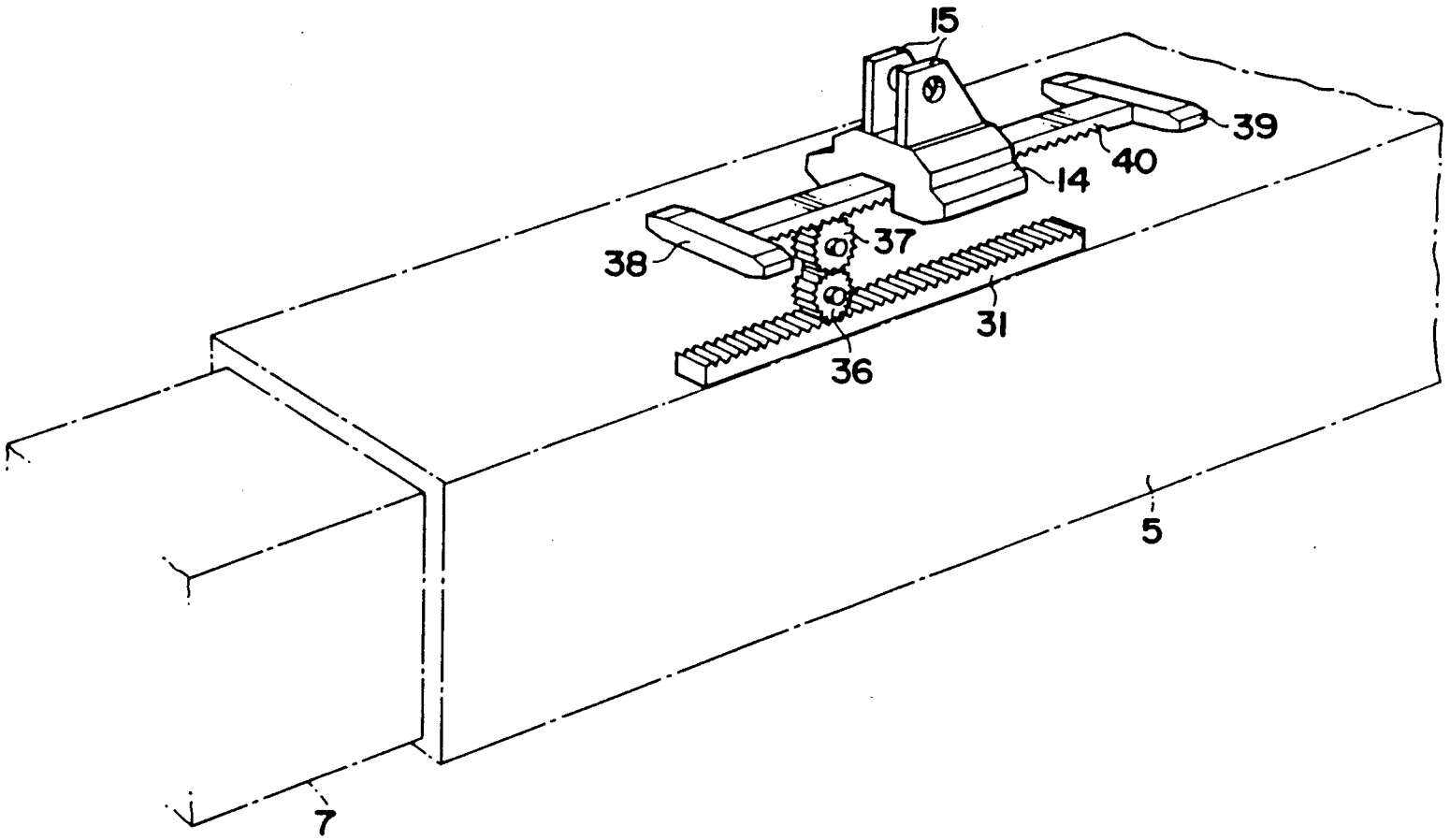
FIG. 8 is an exploded perspective view of assistance in explaining an arrangement of a synchronous mechanism, a constituent of the excavator of FIG. 6.
Figure 9:
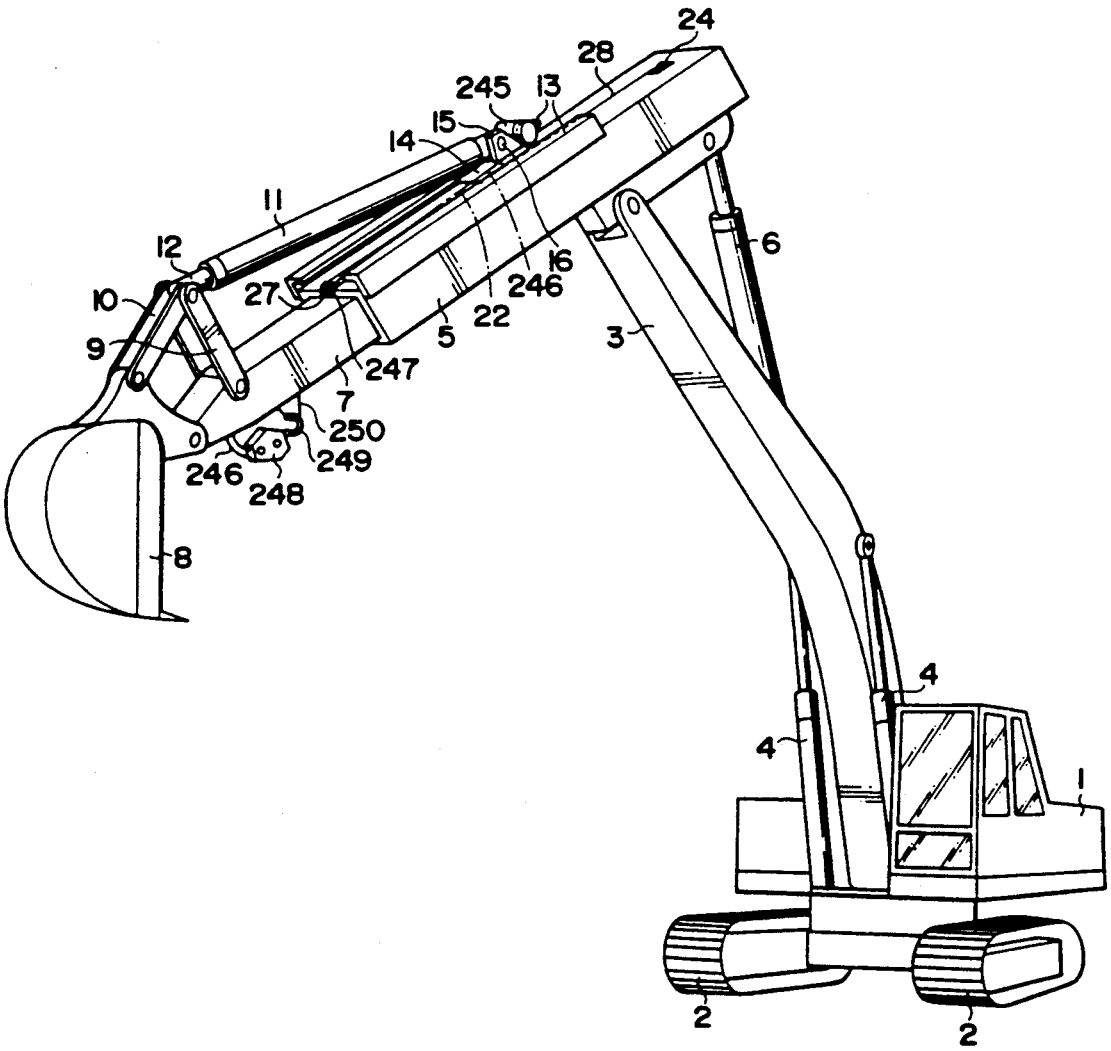
FIG. 9 is a perspective view of an excavator according to a third embodiment of the present invention.

Second Embodiment (FIGS. 6 to 8)

An excavator having a modified synchronous mechanism according to a second embodiment of the present invention will be described with reference to FIGS. 6 to 8. The elements same as those employed in the first embodiment are designated at the same numerals and the explanation thereof is omitted.

A recessed portion 30 is defined at the upper central portion of the inner arm 7 in the longitudinal direction thereof and has a rack 31 at the bottom thereof. The outer arm 5 has a hole 32 in the sidewall thereof portion thereof. Shaft supporting plates 33 are fixed to the central upper portion of the inner arm 7 and extending downward to the direction of the recessed portion 30 in parallel from both sides of the hole 32. Pinions 36, 37 are supported by the shafts 34, 35 fixed to the shaft supporting plates 33. Pinion 36 meshes with the rack 31 and both the pinions 36, 37 mesh with each other. The upper teeth of the pinion 37 protrude from the upper surface of the outer arm 5.

The pair of guide plates 13 have guides 38, 39 interposed therebetween and at the front and the rear portions thereof. The guides 38, 39 are slidably inserted between the pair of guide plates 13 and have a rack 40 which has teeth surface directed downward and extending between the guides 38, 39. The guides 38, 39 and the rack 40 are assembled in the shape of H. The guides 38, 39 and the rack 40 are guided by the guide plates 13 and are movable in the longitudinal direction of the outer arm 5. The rack 40 meshes with the pinion 37. The slider 14 has a U-shaped recess in the lower portion thereof in which the rack 40 is inserted so that the slider 14 and the rack 40 are connected with each other.

The operation of the excavator according to the second embodiment will be described hereinafter.

When the inner arm 7 is extended from the outer arm 5, the third hydraulic cylinder 17 is operated to push the piston rod 18 out of the third hydraulic cylinder 17. The inner arm 7 is pushed out from the outer arm 5 so that the distance between the bucket 8 and the rear end of the outer arm 5 is lengthened. Simultaneously with the movement of the inner arm 7 the rack 31 is moved to thereby rotate the pinion 36. The movement or rotation of the pinion 36 is inverted in the opposite direction by the pinion 37 and transmitted to the rack 40. Hence, the rack 40 is guided by the guides 38, 39 and moved in the longitudinal direction of the guide plates 13. The direction and amount of movement of the rack 40 are the same as those of the inner arm 7, hence the slider 14 connected with the rack 40 is forced to be moved for the same amount of movement as the inner arm 7. Accordingly, the amount of movement of the bucket cylinder 11 fixed to the slider 14 becomes the same as that of the inner arm 7 whereby the inclination angle of the bucket 8 is kept constant at the same state.

When the bucket 8 is raised by contracting the inner arm 7, the piston rod 18 is moved in the direction of the third hydraulic cylinder 17 so that the inner arm 7 is moved into the inner portion of the outer arm 5. Consequently, the moving operation of the piston rod 18 is transmitted to the rack 40 through the rack 31 and the pinions 36, 37 for thereby permitting the slider 14 to return for the same amount of movement as the inner arm 7. The result is that the inclination angle of the bucket 8 is kept constant at all times and the bucket is moved rearward.

With the arrangements of the excavator according to the first and the second embodiments there are the following advantages.

It is possible to widen the operating range in the working area where the earth and sand is dug by lowering the bucket at the deeper position or stretching the bucket in the lengthwise direction.

Although the length of the boom of the present invention is the same as the boom of the conventional excavator the bucket can be extended to a deeper position compared with the bucket of the conventional excavator whereby the height of the boom is not increased when the excavator is moved or the boom is turned while it rises perpendicular. As a result, the boom is prevented from colliding with electric wires or the construction structure to thereby prevent an accident.

Third Embodiment (FIGS. 9 to 13)

An excavator according to a third embodiment of the present invention will be described with reference to FIGS. 9 to 13.

The excavator of the third embodiment comprises a movable body 1, a boom 3 mounted at one end thereof on a front portion of the movable body 1, first hydraulic cylinders 4 mounted at one end thereof on the front portion of the movable body 1, the first hydraulic cylinders 4 being provided with piston rods connected at the tip ends thereof with substantially the central portion of the boom 3 for moving the boom 3 swingably in the longitudinal direction thereof, an outer arm 5 pivotally swingably mounted on the other end of the boom 3, a second hydraulic cylinder 6 mounted on a rear surface of the boom 3, the second hydraulic cylinder 6 being provided with a piston rod connected to a rear portion of the outer arm 5 for correcting an angular distance between the boom 3 and the outer arm 5, an inner arm 7 inserted into the outer arm 5 and movable telescopically relative to the outer arm 5 in the longitudinal direction of the outer arm 5, a bucket 8 connected to the tip end of the inner arm 7, a bucket cylinder 11 provided with a piston rod having one end connected to the bucket 8, a guide mechanism 14 slidably mounted on guide plates 13 fixed to the outer arm 5 and connected to the rear end of the bucket cylinder for operating the bucket cylinder to thereby stretch the piston rod from the bucket cylinder 11 so that the angular distance between the bucket 8 and the inner arm 7 is kept unchanged in synchronism with the amount of movement of the inner arm 7, a third hydraulic cylinder 17 connected to a base end of the outer arm 5 at the base thereof and having a piston rod 18 connected to a central portion of the inner arm 7 for moving the inner arm 7 relative to the outer arm 5, a synchronous means for moving the base end of the outer arm 5 for the length corresponding to the telescopical stretchable length of the inner arm 7 and a hook mechanism mounted at a front portion of the inner arm 7.

The hook mechanism of the excavator according to the third embodiment will be described more in detail hereinafter.

The slider 14 has a hoist 245 fixed to the rear end thereof. A wire 246 drawn from the hoist 245 is inverted by a pulley 247 provided at the outer arm 5 and is guided in the direction of the outer arm 5 through the space between the outer arm 5 and the inner arm 7. A pulley 251 is supported at the rear inner portion of the outer arm 5 and the wire 246 is inverted by the pulley 251 and guided to the inner central portion of the inner arm 7. A pulley 252 is supported at the tip end portion of the inner arm 7 and the wire 246 is directed downward by the pulley 252. The hook body 248 is hung by the wire 246 directed downward. The hook body 248 has a hook 249 fixed to the lower portion of the hook body 248 and is kept hung by a hook receiver 250 attached to the lower surface of the front portion of the inner arm 7 substantially in U-shape when it is not used.

The excavator according to the third embodiment hangs the heavy material in the following manner.

The hook 249 is removed from the hook receiver 250 so that the hook body 248 is hung downward freely. The hoist 245 is operated to unwind the wire 246 so that the wire 246 is drawn out through the pulleys 247, 251, 252 so that the hook body 248 is hung downward from the tip end of the inner arm 7. After the heavy material is hooked by the hook 249 with use of a wire suspender, the hoist 245 is reversely rotated to thereby wind the wire 246 therearound. The hook body 248 hung by the wire 246 is raised to thereby lift the heavy material upward. When the heavy material thus hung on the hook 249 is moved upward, the third hydraulic cylinder 17 is operated to push up the piston rod 18 so that the inner arm 7 slides away from the outer arm 5 and the hook body 248 is moved away from the movable body 1. At this time the slider 14 is moved by the chain 29. Since the amount of movement of the slider 14 is synchronous with that of the inner arm 7 the wire 246 is neither slackened nor pulled up but drawn out with the length thereof being unchanged, the hook body 248 is prevented from being vertically moved by the sliding of the inner arm 7 so that the heavy material can be moved with the height of the hook body 248 being kept at the same level.

Figure 10:
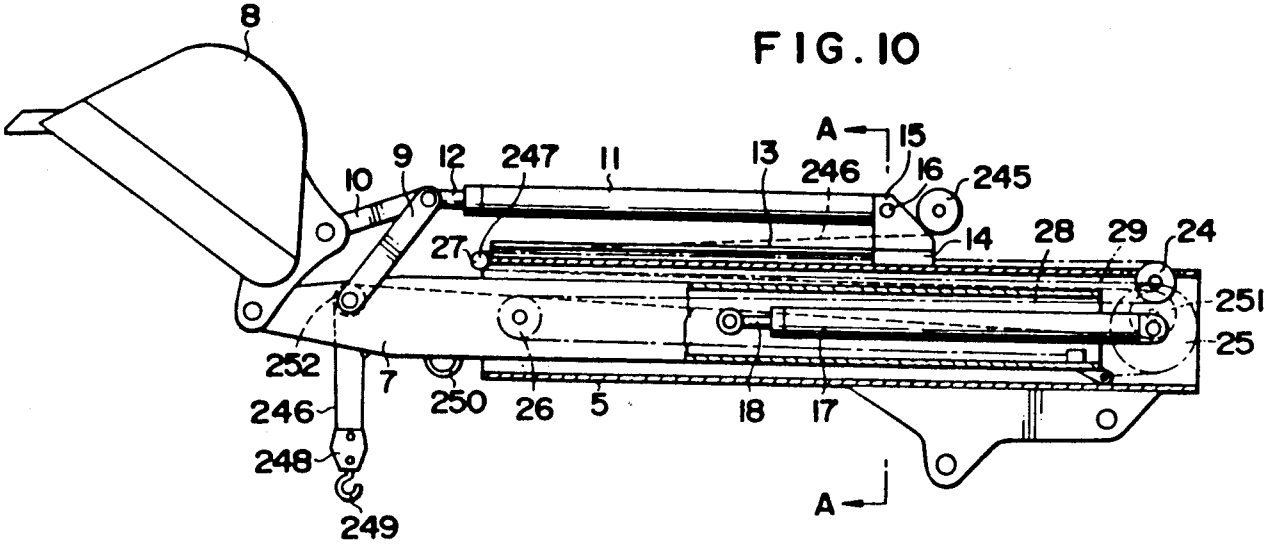
FIG. 10 is a cross sectional view showing an internal arrangement of an outer arm, a constituent of the excavator of FIG. 9.
Figure 11:
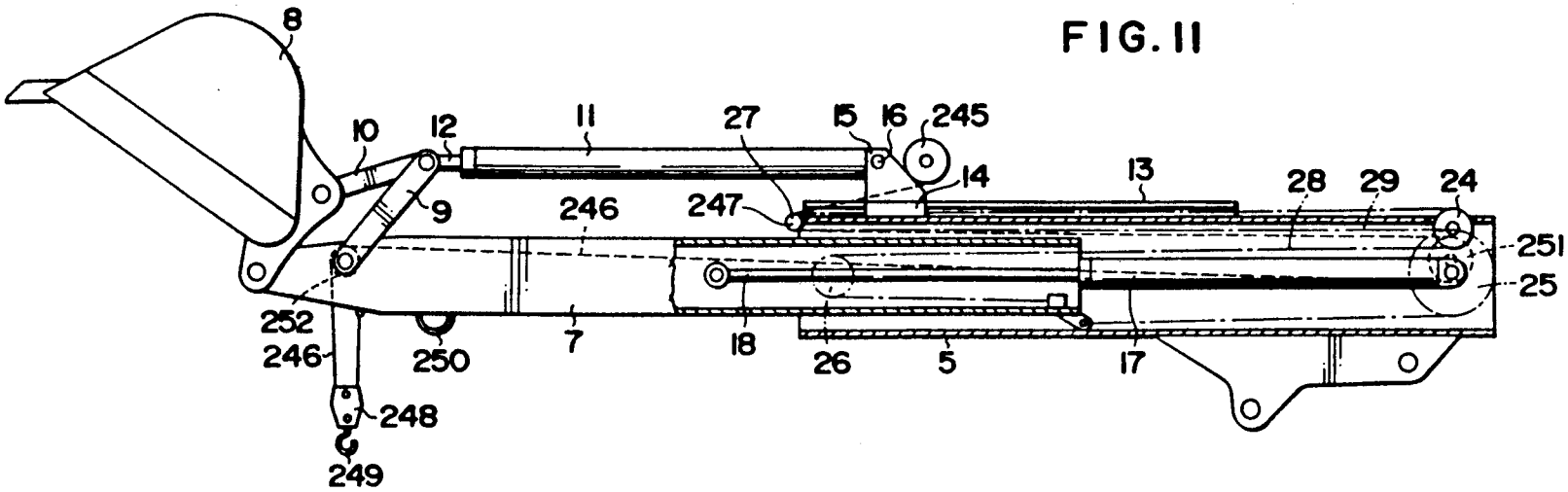
FIG. 11 is a cross sectional view of assistance in explaining a state where an inner arm, a constituent of the excavator of FIG. 9, is drawn from the outer arm of FIG. 10.
Figure 12:
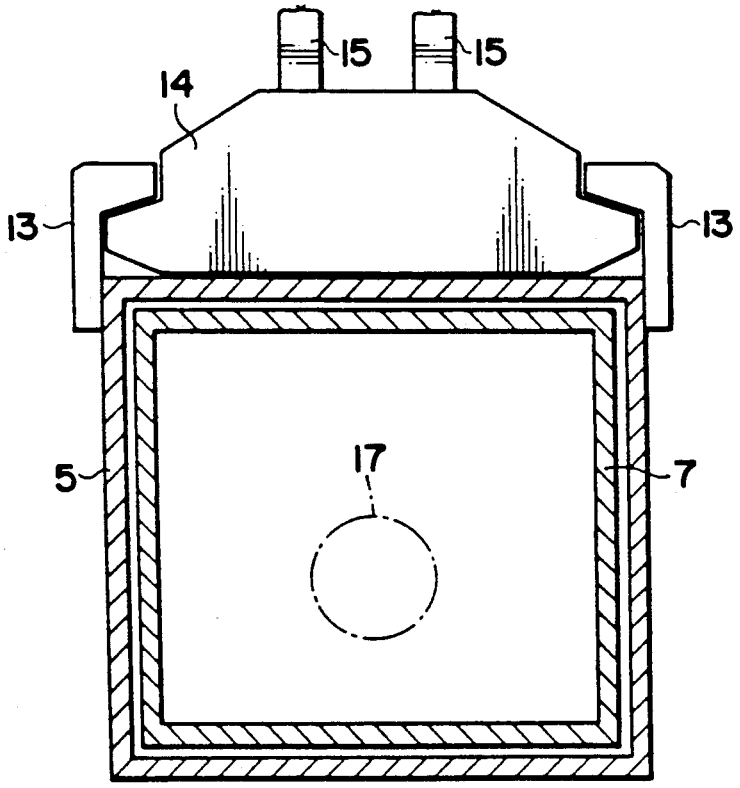
FIG. 12 is a cross sectional view taken along the section line A—A of FIG. 10.
Figure 13:
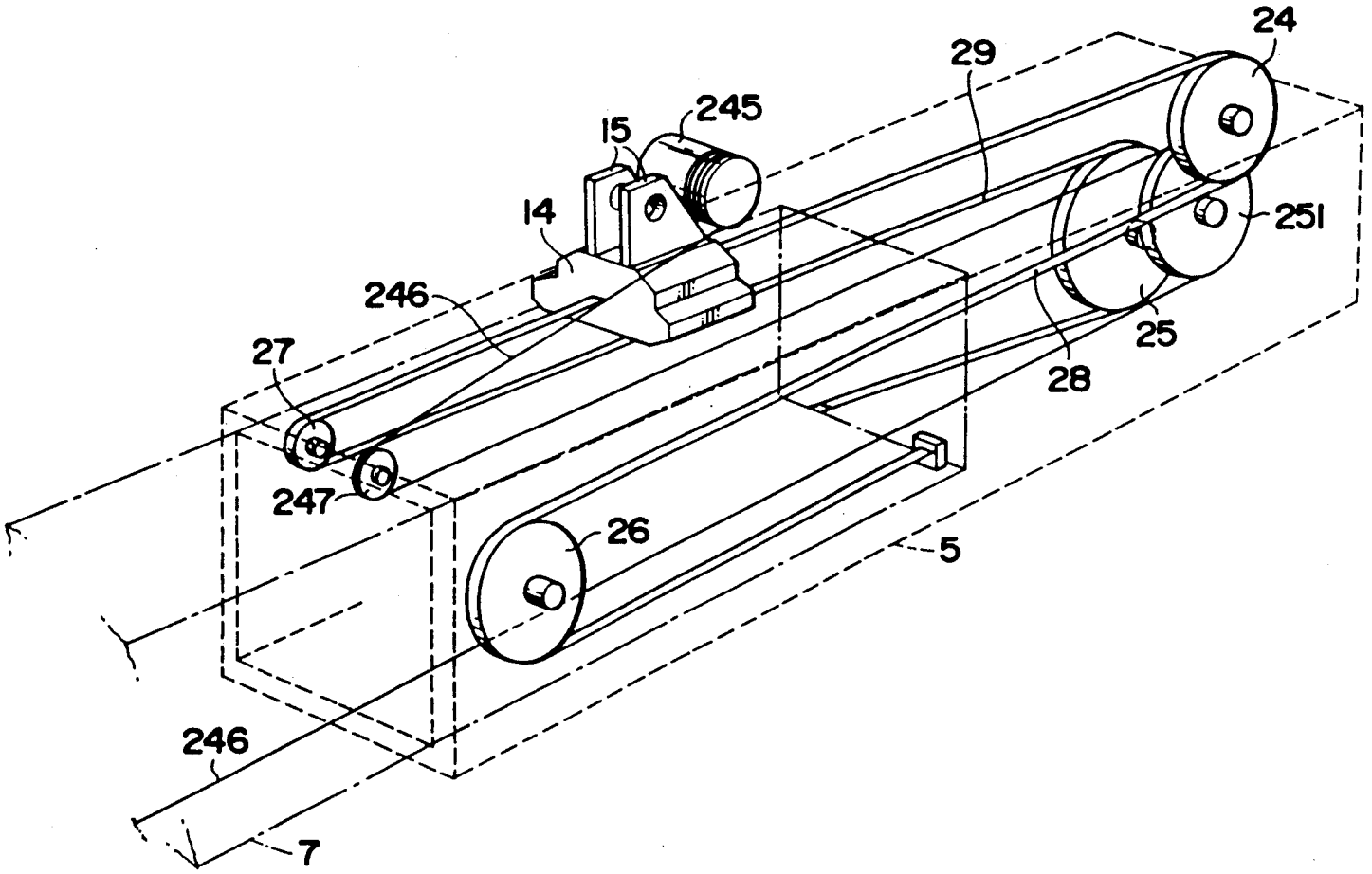
FIG. 13 is an exploded perspective view of assistance in explaining an arrangement of a synchronous mechanism, a constituent of the excavator of FIG. 9.

When the heavy material is raised upward by the hook body 248 the bucket cylinder 11 is contracted as shown in FIGS. 10 and 11 to thereby turn the bucket 8 upward through a large range of motion. When angles of attack of the inner arm 7 and the outer arm 5 are varied, the second hydraulic cylinder 6 is operated to vary the inclination angles thereof. Upon completion of the operation of lowering the heavy material, the hook 249 is hooked by the hook receiver 250 to thereby slightly pull up the wire 246 so that the hook body 248 is fixed to the inner arm 7.

Figure 14:
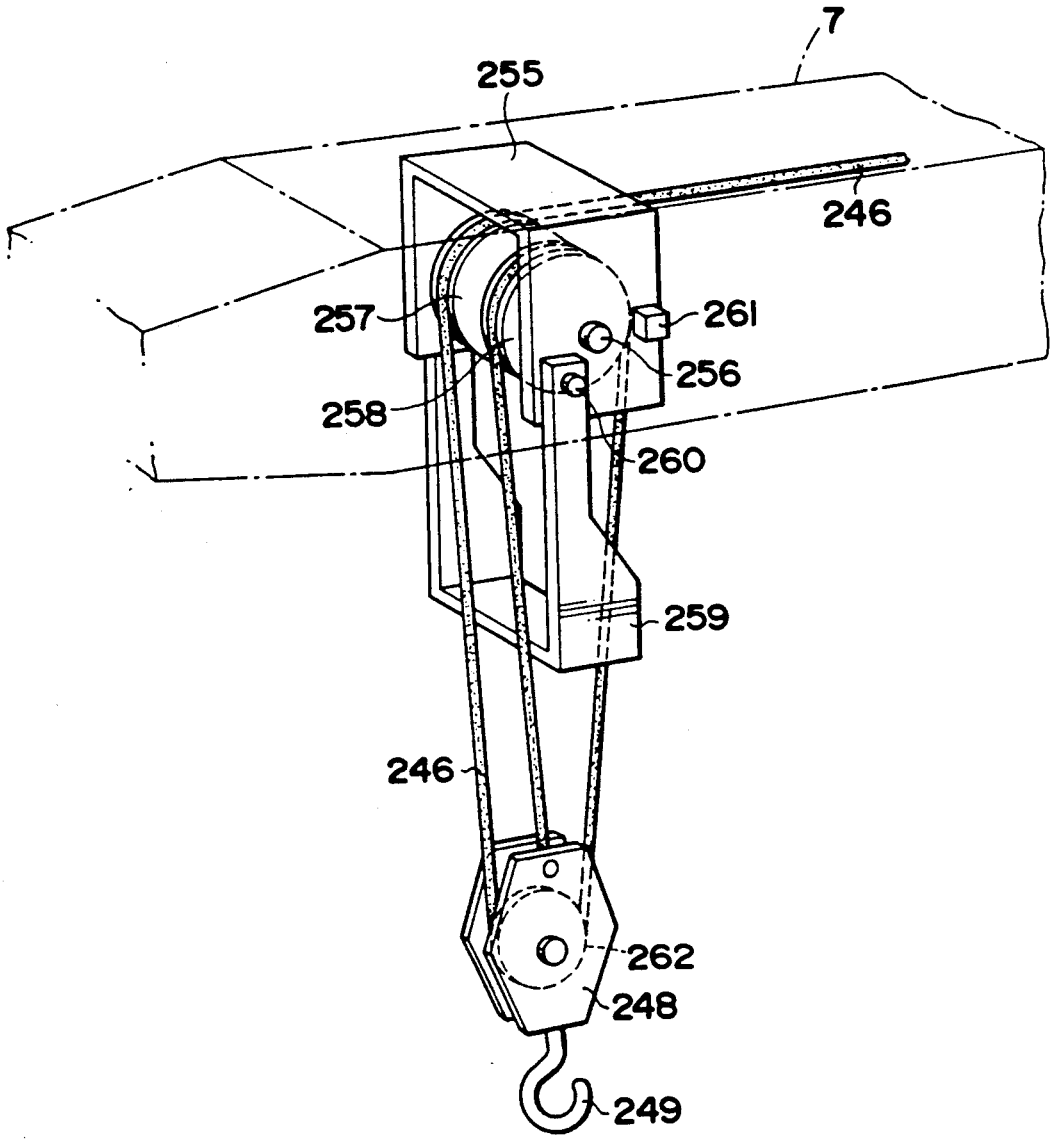
FIG. 14 is an exploded perspective view of assistance in explaining a hook mechanism, a constituent of an excavator according to a fourth embodiment of the present invention.

Fourth Embodiment (FIGS. 14 to 15)

An excavator having a modified hook body according to a fourth embodiment of the present invention will be described with reference to FIGS. 14 to 15. The hook receiver 250 as employed in the third embodiment is unnecessary in the fourth embodiment.

A U-shaped head 255 having a downwardly directed opening is attached to the inner portion of the front of the inner arm 7. Two pulleys 257, 258 are rotatively supported by a shaft 256 within the head 255. The head 255 has an inversed body 259 at the lower portion thereof and the inversed body 259 is rotatively supported by a pin 260 which is slightly displaced from the shaft 256 in the direction of the bucket 8. The head 255 has stoppers 261 protruding from both sides thereof and fixed thereto so that the inversed body 259 can contact the stoppers 261. The hook body 248 has a pulley 262 which is supported inside thereof. The wire 246 is inverted downward by the pulley 257 and further inverted upward by the pulley 262 and thereafter inverted downward by the pulley 258. The wire 246 is connected to the upper portion of the hook body 248 at one end thereof.

The operation of the excavator having such modified hook body according to the fourth embodiment of the present invention will be described with reference to FIGS. 15(A) to 15 (C).

Figure 15C:
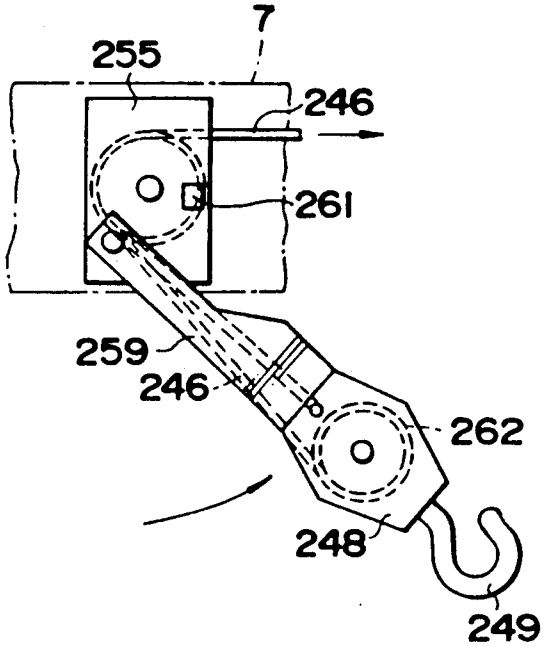
FIGS. 15(A) to 15(C) are views of assistance in explaining the manner of accommodating a hook body of the hook mechanism of FIG. 14.
Figure 15B:
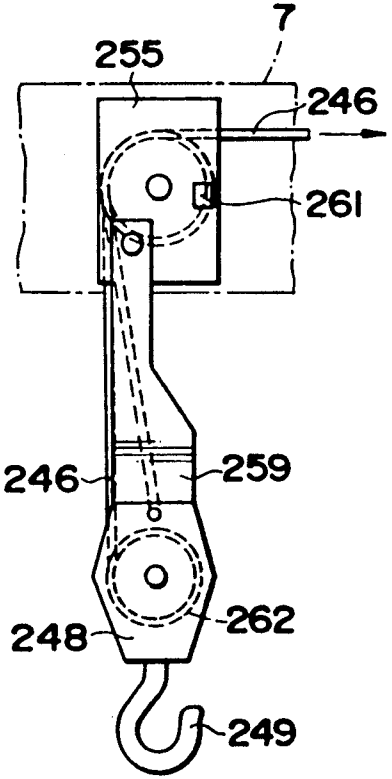
Figure 15A:
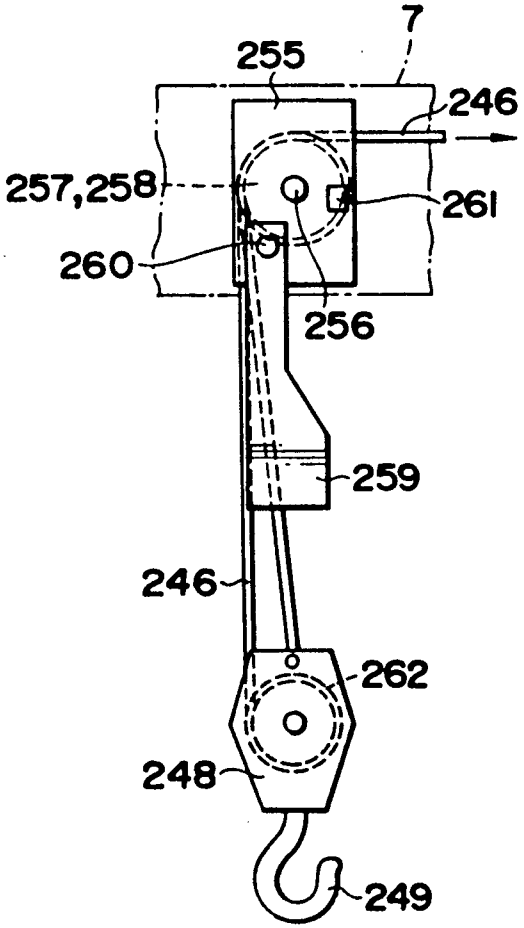

FIG. 15(A) shows the hook body 248 which is hung downward by the head 255, namely, not accommodated inside the inner arm 7. At this state when the wire 246 is wound around the hoist 245 the hook body 248 is moved upward by the wire 246. The upper surface of the hook body 248 contacts the lower portion of the inversed body 259 as illustrated in FIG. 15(B). If the wire is further wound by the hoist 245 at this state, inasmuch as the length of the wire is limited by the inversed body 259, the force of the wire 246 is directly applied to the inversed body 259 so that the force of the wire 246 is changed to a perpendicular force which is applied to the inversed body 259. Inasmuch as the pin 260 of the inversed body 259 and the shaft 256 to which the upward force is applied, namely, a center of the upward force are displaced, the force of the wire 246 becomes a component to turn the inversed body 259, hence, the force of the wire 246 becomes the force, as shown in FIG. 15(C), to raise upward the inversed body 259 and the hook body 248 as they are kept positioned at that state. Accordingly, when the wire 246 is wound around the hoist 245, the inversed body 259 is raised upward to a horizontal position so that the inversed body 259 contacts the stopper 261 and is stopped at that state.

Inasmuch as the hook body 248 is inverted by the inversed body 259 from the vertical direction to the horizontal direction, the hook body 248 is directly accommodated inside the inner arm 7. When the hook body 248 is accommodated inside the inner arm 7 the hook body 248 is not visible from the outside so that the inner arm 7 is shaped as if it has no protrusion therefrom linearly. Hence, when the bucket 8 is operated to dig the earth and sand the hook 248 is not an obstacle to the digging operation thereof.

Figure 16:
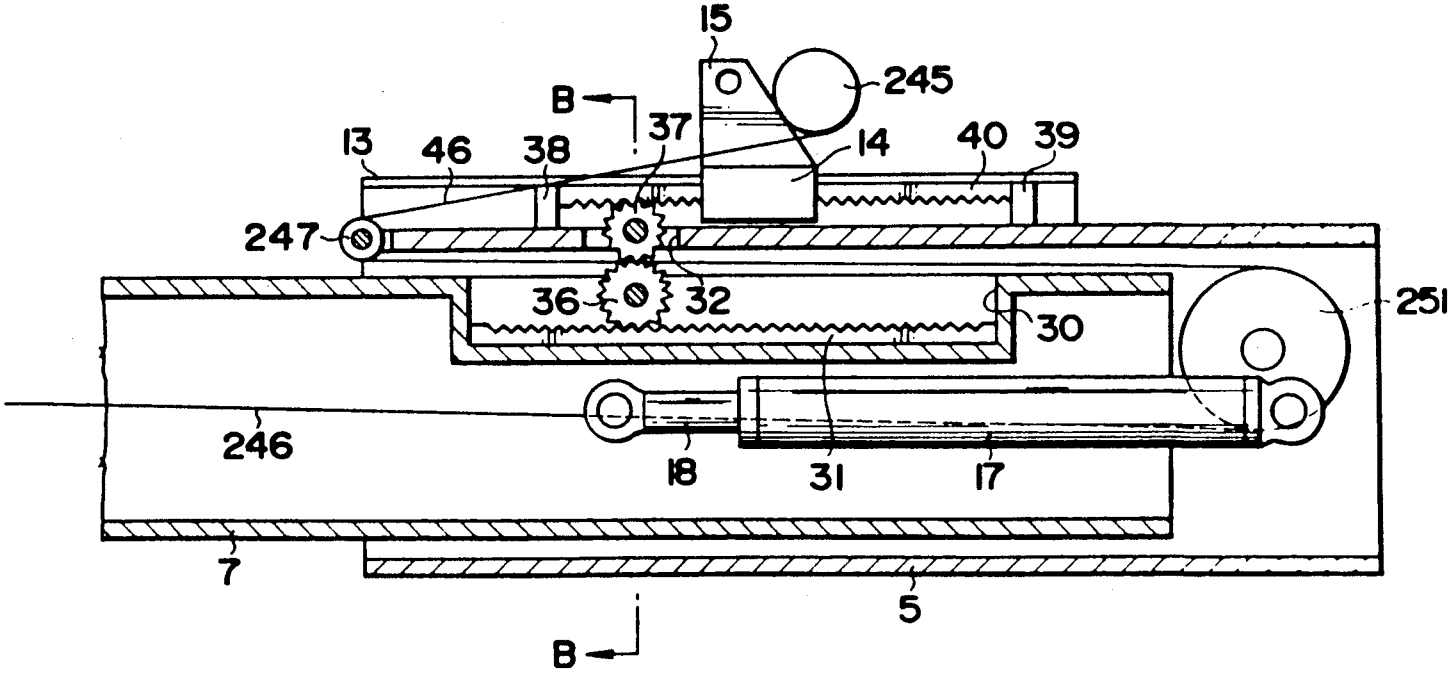
FIG. 16 is a side cross sectional view showing an internal arrangement of an outer arm employed in an excavator according to a fifth embodiment of the present invention.
Figure 17:
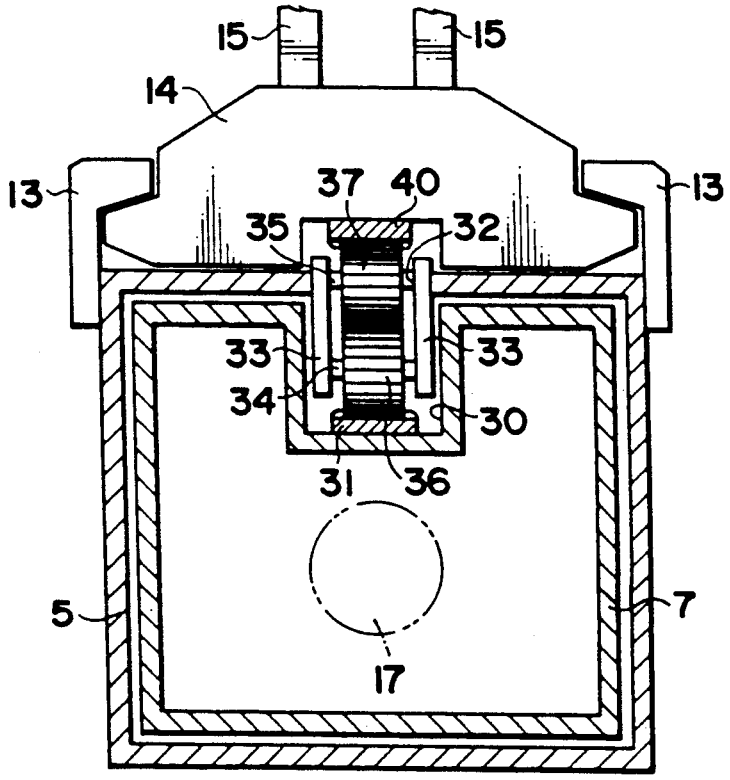
FIG. 17 is a cross sectional view taken along the section line B—B of FIG. 16.
Figure 18:
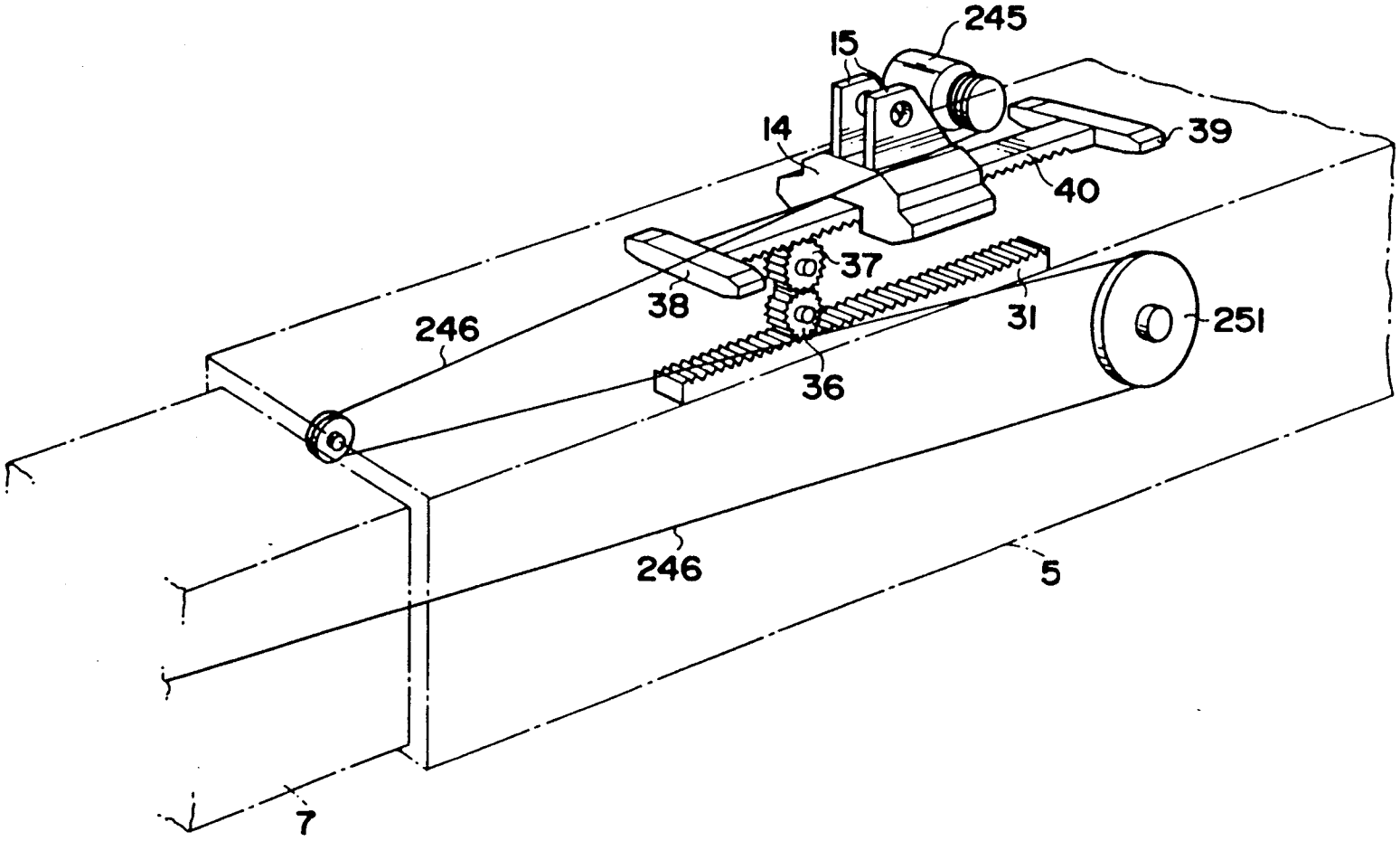
FIG. 18 is an exploded perspective view of assistance in explaining an arrangement of a synchronous mechanism, a constituent of the excavator of FIG. 16.
Figure 19:
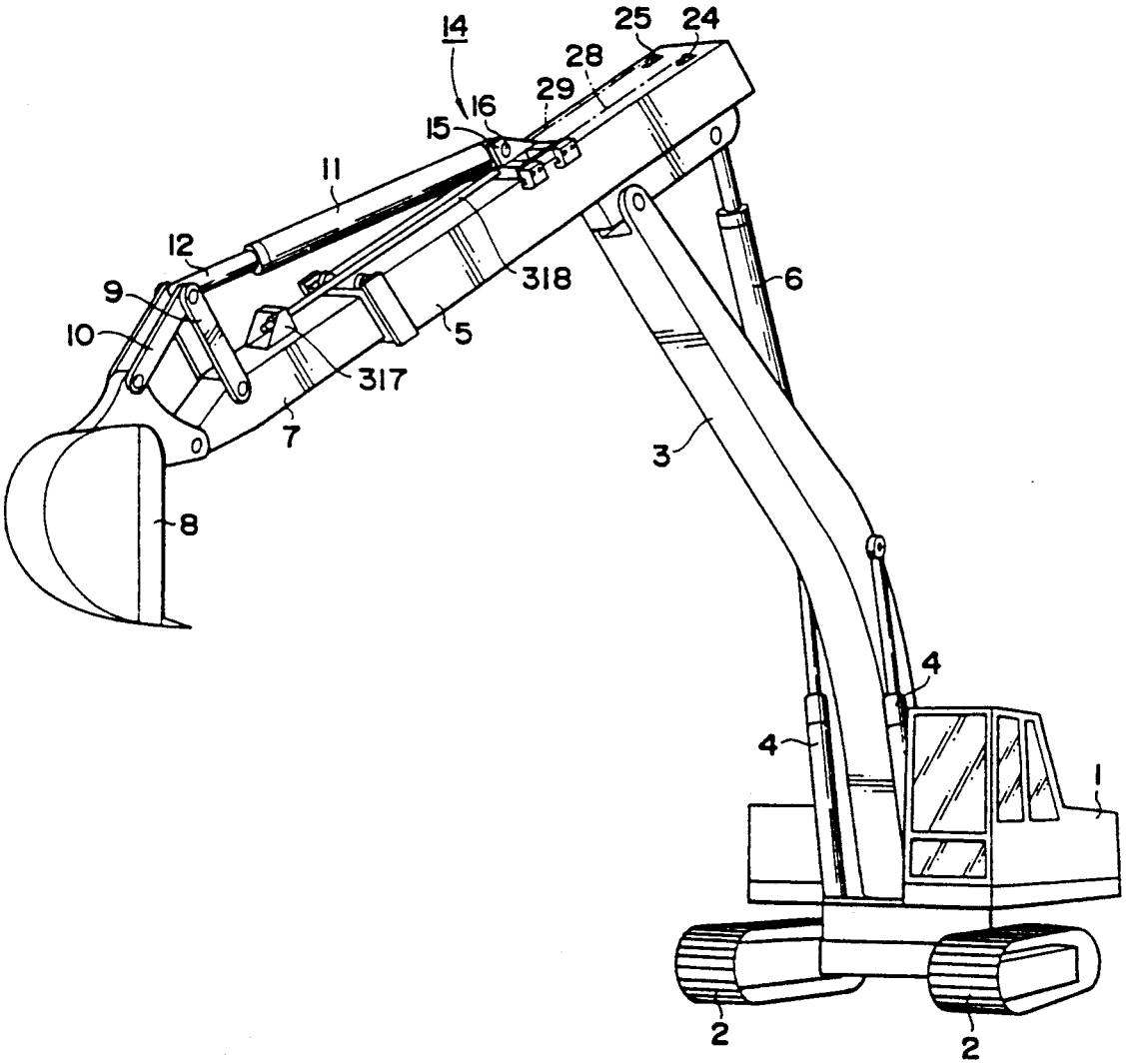
FIG. 19 is a perspective view of an excavator according to a sixth embodiment of the present invention.
Figure 20:
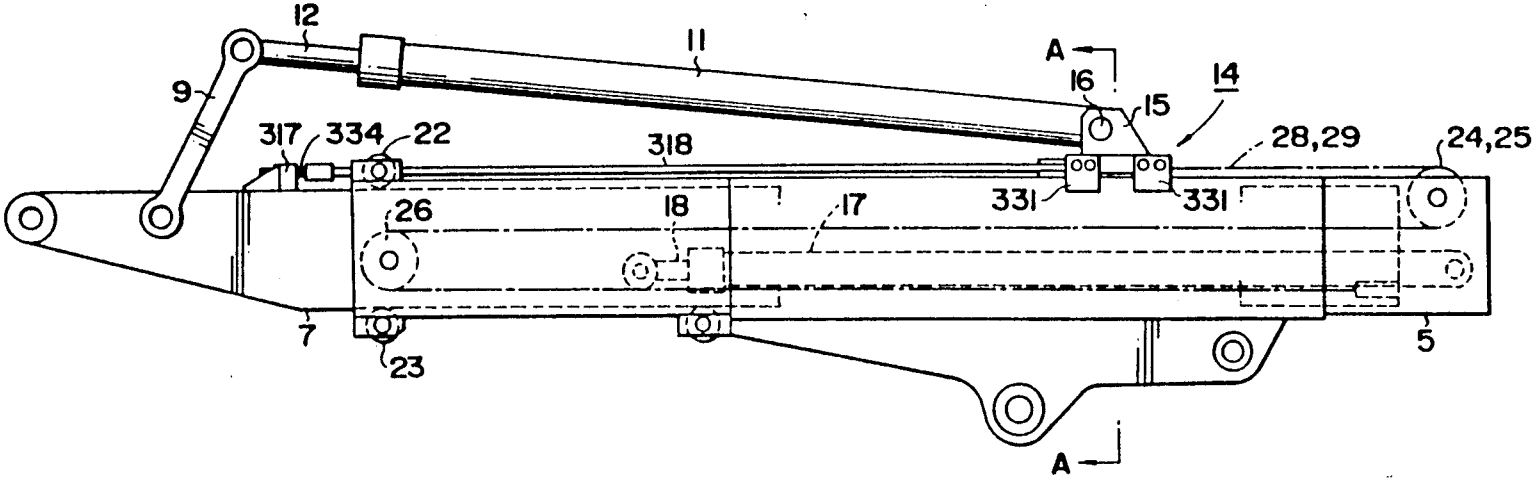
FIG. 20 is a cross sectional view showing an internal arrangement of an outer arm, a constituent of the excavator of FIG. 19.
Figure 21:
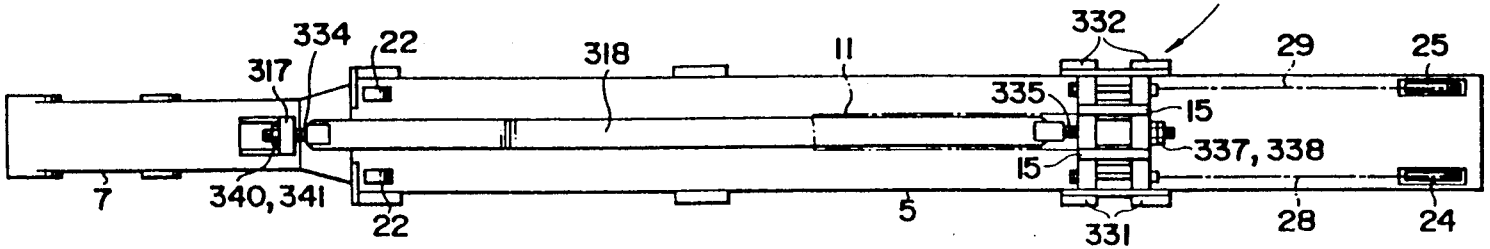
FIG. 21 is a plan view of FIG. 20.
Figure 22:
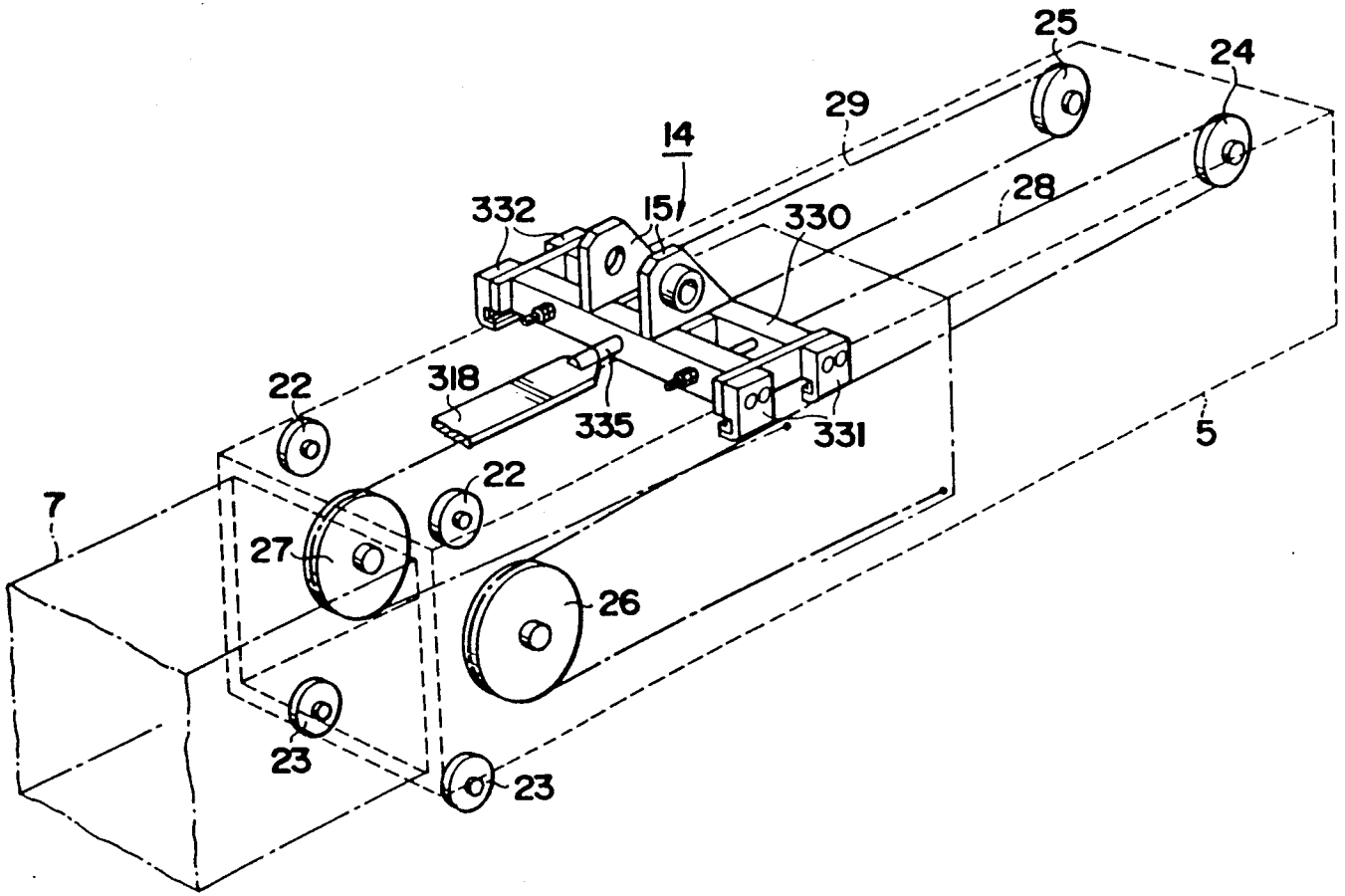
FIG. 22 is a perspective view of assistance in explaining an arrangement of a synchronous mechanism, a constituent of the excavator of FIG. 19.

Fifth Embodiment (FIGS. 16 to 18)

An excavator having a modified synchronous mechanism according to a fifth embodiment of the present invention will be described with reference to FIGS. 16 to 18.

A recessed portion 30 is defined at the upper central portion of the inner arm 7 in the longitudinal direction thereof and has a rack 31 at the bottom thereof. The outer arm 5 has a hole 32 through the upper wall thereof. Shaft supporting plates 33 are fixed to the central upper portion of the inner arm 7 and extending downward to the direction of the recessed portion 30 in parallel from both sides of the hole 32. Pinions 36, 37 are supported by the shafts 34, 35 fixed to the shaft supporting plates 33 in which the pinion 36 meshes with the rack 31 and both the pinions 36, 37 mesh with each other. The upper teeth surface of the pinion 37 protrude from the upper surface of the outer arm 5.

The pair of guide plates 13 have guides 38, 39 interposed therebetween and at the front and the rear portions thereof. The guides 38, 39 are slidably inserted between the pair of guide plates 13 and have a rack 40 which has a teeth surface directed downward and connected between the guides 38, 39. The guides 38, 39 and the rack 40 are assembled in the shape of H. The guides 38, 39 and the rack 40 are guided by the guide plates 13 and movable in the longitudinal direction of the outer arm 5. The rack 40 meshes with the pinion 37. The slider 14 has a lower U-shaped recess in which the rack 40 is inserted so that the slider 14 and the rack 40 are connected with each other.

The excavator has a hoist 245, a pulley 247, a pulley 251 and a cable 246 for operating a hook mechanism. These parts are constructed and arranged as described above for the third embodiment of the invention and, accordingly, further description thereof is believed unnecessary.

The operation of the excavator according to the fifth embodiment will be described hereafter.

When the inner arm 7 is drawn out from the outer arm 5, the third hydraulic cylinder 17 is operated to push out the piston rod 18. The inner arm 7 is pushed out from the outer arm 5 so that the distance between the bucket 8 and the rear end of the outer arm 5 is extended. Simultaneously with the movement of the inner arm 7 the rack 31 is moved to thereby rotate the pinion 36. The rotation of the pinion 36 is inverted in the opposite direction by the pinion 37 and transmitted to the rack 40. Hence, the rack 40 is guided by the guides 38, 39 and moved in the longitudinal direction of the guide plates 13. The direction and amount of movement of the rack 40 are same as those of the inner arm 7, hence, the slider 14 connected with the rack 40 is forced to be moved for the same amount of movement as the inner arm 7. Accordingly, the amount of movement of the bucket cylinder 11 fixed to the slider 14 becomes the same as that of the inner arm 7 whereby the inclination angle of the bucket 8 is kept constant at the same state.

When the bucket 8 is raised by contracting the inner arm 7, the piston rod 18 is drawn in the direction of the third hydraulic cylinder 17 so that the inner arm 7 is moved in the inner portion of the outer arm 5. Consequently, the moving operation of the piston rod 18 is transmitted to the rack 40 through the rack 31 and the pinions 36, 37 for thereby permitting the slider 14 to return for the same amount of movement as the inner arm 7. As a result, the bucket 8 is moved rearward with its inclination angle being kept constant at all times.

With the arrangement of the excavator according to the third and the fifth embodiments there are following advantages.

It is possible to carry out the operation to dig the earth and sand and the operation of hanging the heavy material by the same excavator so that a safe working operation can be effected by the single excavator provided with the different functions.

The excavator can eliminate the provision of an exclusive crane mechanism provided at the boom as has been employed in the conventional excavator since the inner arm can slide relative to the outer arm so that the heavy material can be moved in the longitudinal direction of the arms, the same as is the ordinary crane mechanism, whereby the structure thereof is remarkably simplified and can be manufactured with ease. It is possible to widen the working range since the bucket can be moved to the longer distance by moving the inner arm at the case when the bucket is moved to the deeper position in the digging operation.

Sixth Embodiment (FIGS. 19 to 26)

An excavator according to a sixth embodiment will be described with reference to FIGS. 19 to 26.

An excavator comprises a movable body 1, a boom 3 mounted at one end thereof on a front portion of the movable body 1, first hydraulic cylinders 4 mounted at one end thereof on the front portion of the movable body 1, the first hydraulic cylinders being provided with cylinder rods connected at the tip ends thereof with substantially the central portion of the boom 3 for moving the boom 3 swingably in the longitudinal direction thereof, an outer arm 5 pivotally swingably mounted on the other end of the boom 3, a second hydraulic cylinder 6 mounted on a rear surface of the boom 3, the second hydraulic cylinder 6 being provided with a piston rod connected to a rear portion of the outer arm 5 for correcting an angular distance between the boom 3 and the outer arm 5, an inner arm 7 inserted into the outer arm 5 and movable telescopically relative to the outer arm 5 in the longitudinal direction of the outer arm 5, a bucket 8 connected to the tip end of the inner arm 7, a bucket cylinder 11 provided with a piston rod and having one end connected to the bucket 8, a guide mechanism 14 slidably mounted on guide plates 13 fixed to the outer arm 5 and connected to the rear end of the bucket cylinder for operating the bucket cylinder to thereby stretch the piston rod from the bucket cylinder 11 so that the angular distance between the bucket 8 and the inner arm 7 is kept unchanged with synchronism with the amount of movement of the inner arm 7, a third hydraulic cylinder 17 connected to a base end of the outer arm 5 at the base thereof and having a piston rod 18 connected to a central portion of the inner arm 7 for moving the inner arm 7 relative to the outer arm 5, a synchronous means for moving the base end of the outer arm 5 for the length corresponding to the telescopical stretchable length of the inner arm 7, and interlocking means connected between the guide mechanism and the front portion of the inner arm 7.

The synchronous means will be described hereinafter.

Rollers 22, 23 having respectively small diameters are supported at the upper and lower surfaces of the tip end of the outer arm 5 so that the inner arm 7 can be smoothly moved relative to the outer arm 5. Sprocket wheels 24, 25 are supported at the rear end of the outer arm 5 and at both sides thereof with the upper half surface thereof being exposed above the upper surface of the outer arm 5. Sprocket wheels 26, 27 are supported by the outer arm 5 at the outer end thereof and adjacent to both sides of the inner arm 7. The chain 28 is connected to the rear end of the slider 14 at the tip end thereof and inverted by the sprocket wheel 24, extends through the space between the inner arm 7 and the outer arm 5, and extends in the direction of the bucket 8 and is further inverted by the sprocket wheel 26. The chain 28 is connected to the rear end of the inner arm 7. The chain 29 is connected to the slider 14 at the rear end thereof, is inverted by the sprocket wheel 25, extends through in the space between the inner arm 7 and the outer arm 5 and extends in the direction of bucket 8, and is further inverted by the sprocket wheel 27. The chain 29 is connected to the rear end of the inner arm 7 at the rear end thereof.

Figure 23:
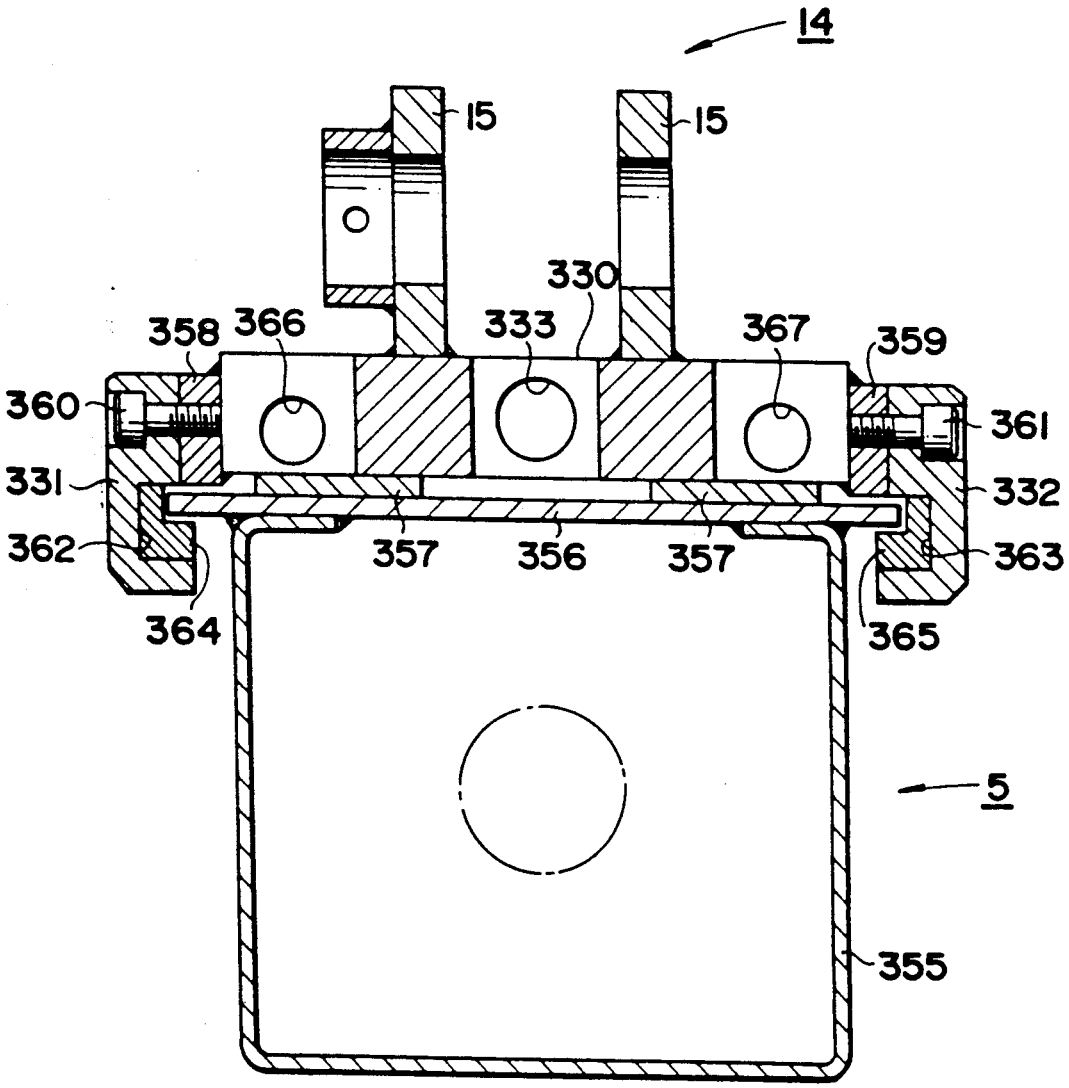
FIG. 23 is a cross sectional view taken along the section line A—A of FIG. 20.
Figure 24:
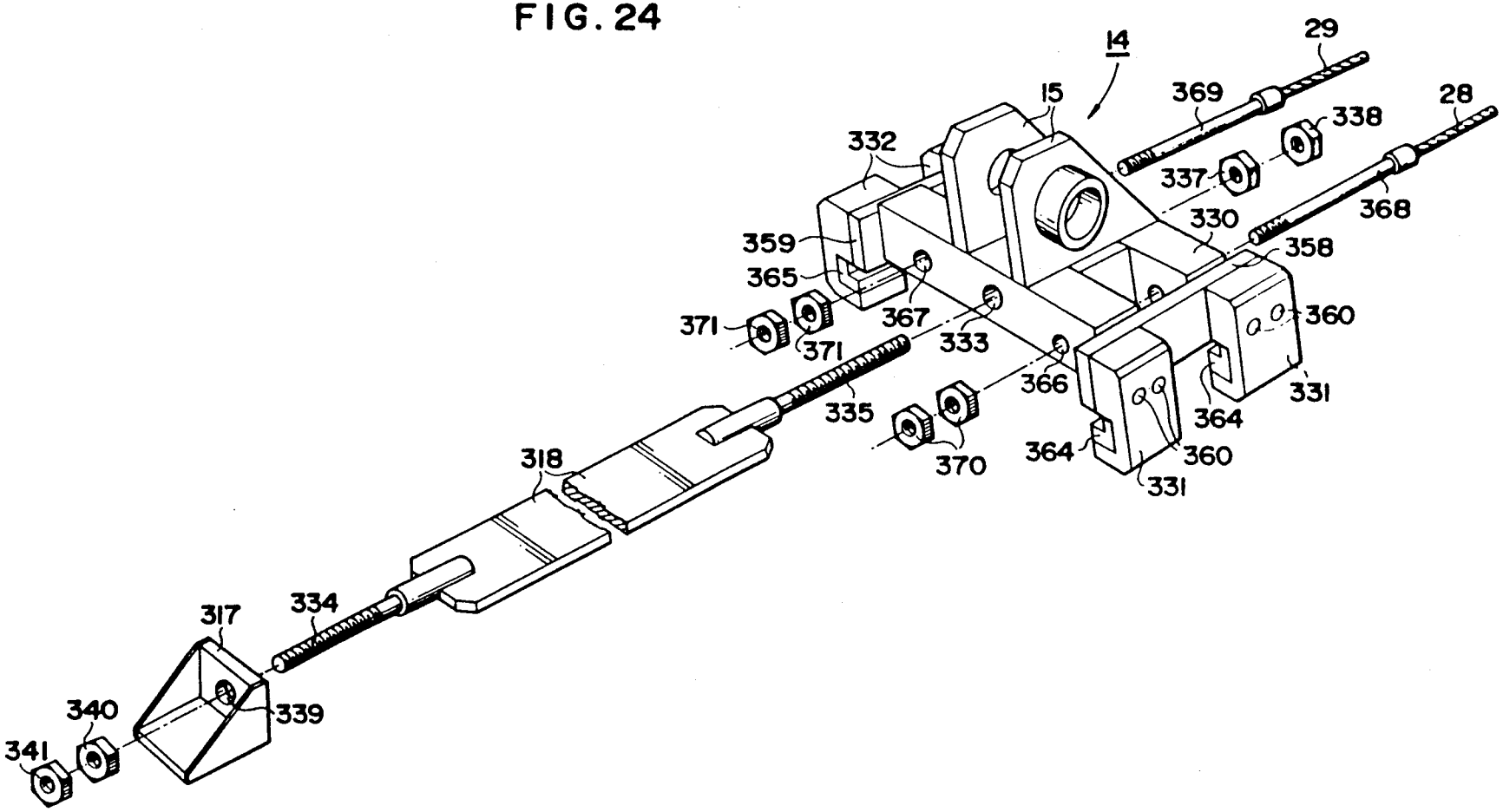
FIG. 24 is an exploded perspective view of assistance in explaining an arrangement of a synchronous mechanism of FIG. 22.

An arrangement of the slider 14 will be described more in detail with reference to FIGS. 23 and 24.

The outer arm 5 comprises a barrel 355 made of a steel plate bent in C-shape and a roofed portion 356 fixed to the barrel 355 so as to close the opening in the upper side of the barrel 355. The roofed portion 356 has both ends respectively protruding beyond both side surfaces of the barrel 355 and assembled with the slider 14 for preventing the slider 14 being dropped from the both ends of the roofed portion 356.

The slider 14 as the guiding mechanism comprises a substantially H-shaped body 330 having a width at the central portion thereof the same as the width of the outer arm 5. Sliding bodies 357 made of MC nylon and the like are fixed to the lower surface of the body 330 and contact the upper surface of the roofed portion 356 at the lower surface thereof so that the slider 14 can be smoothly slided by the sliding bodies 357. The pair of shaft supporting plates 15 are disposed in parallel with a predetermined spacing therebetween and are fixed to the upper surface central portion of the body 330. The bucket cylinder 11 is inserted between the pair of shaft supporting plates 15 at the base thereof. Flat shaped attaching plates 358, 359 are fixed to the both sides of the body 330 and have guide bodies 331, 332 fixed thereto by screws 360, 361 for engaging with the roofed portion 356.

Guide bodies 331, 332 have respectively recessed portions 362, 363 formed in C-shape at the lower inside portions thereof. The recessed portions 362, 363 have respectively L-shaped sliding members 364, 365 made of MC nylon and the like and engaged in the inner walls thereof. The sliding members 364, 365 can guide the slider 14 while they contact the end portions of the roofed portion 356. The slider 14 can be moved without slipping off the roofed portion 356, namely, the upper side of the outer arm 5. A connecting through hole 333 penetrates the central portion of the body 330 horizontally so as to become perpendicular relative to the longitudinal direction of the body 330. Joint holes 366, 367 are defined at right and left sides of the connecting through hole 333 by penetrating the body 330.

An interlocking bar 318 is made of a thin metal band having high rigidity and has fixing screws 334, 335 fixed to the front end and the rear end thereof by welding and the like for applying tension thereto. The fixing screw 335 is inserted into the connecting through hole 333 and screwed in double by nuts 337, 338 at the rear portion of the body 330 and fixed to the body 330. The fixing screw 334 is inserted into a hole 339 defined by opening a perpendicular member of a fixing member 317 and screwed in double by nuts 340, 341 and fixed to the fixing member 317. The interlocking bar 318 adjusts the spacing between the fixing member 317 and the slider 14 by the fixing screws 334, 335 and can determine a tensile strength freely by adjusting the nuts 337, 338, 340, 341.

The chains 28, 29 are connected to long screws 368, 369 at tip ends thereof. The long screw 368 is inserted into the joint hole 366 and screwed in double by nuts 370 and fixed to the body 330 at the rear portion thereof. The long screw 369 is inserted into the joint hole 367 and screwed in double by nuts 371 and fixed to the body 330 at the rear portion thereof.

The operation of the excavator according to the sixth embodiment will be described hereinafter.

The crawlers 2 are driven to move the movable body 1 toward the place where the trenches and the holes are to be dug. The bucket 8 is positioned at the location where the earth and sand is dug and the first and the second and the third hydraulic cylinders 4, 6 and the bucket cylinder 11 are operated in interlocking manner to thereby turn the bucket 8 so that the bucket 8 can dig the earth and sand. The operation is the same as that of the conventional excavator.

Figure 25:
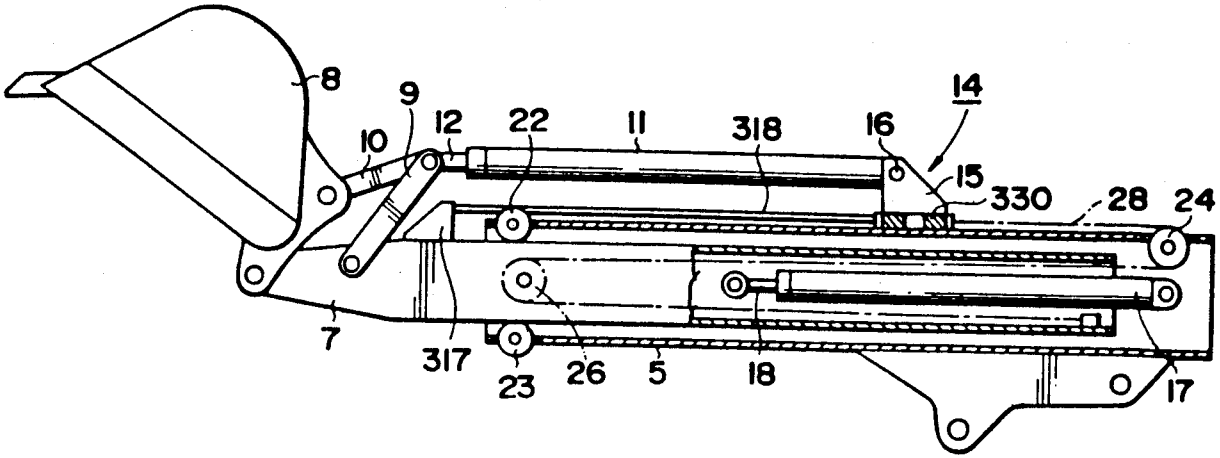
FIG. 25 is a side cross sectional view of assistance in explaining a contracted state of an inner arm where the inner arm is drawn into an outer arm, the inner arm and the outer arm being constituents of the excavator of FIG. 19.
Figure 26:
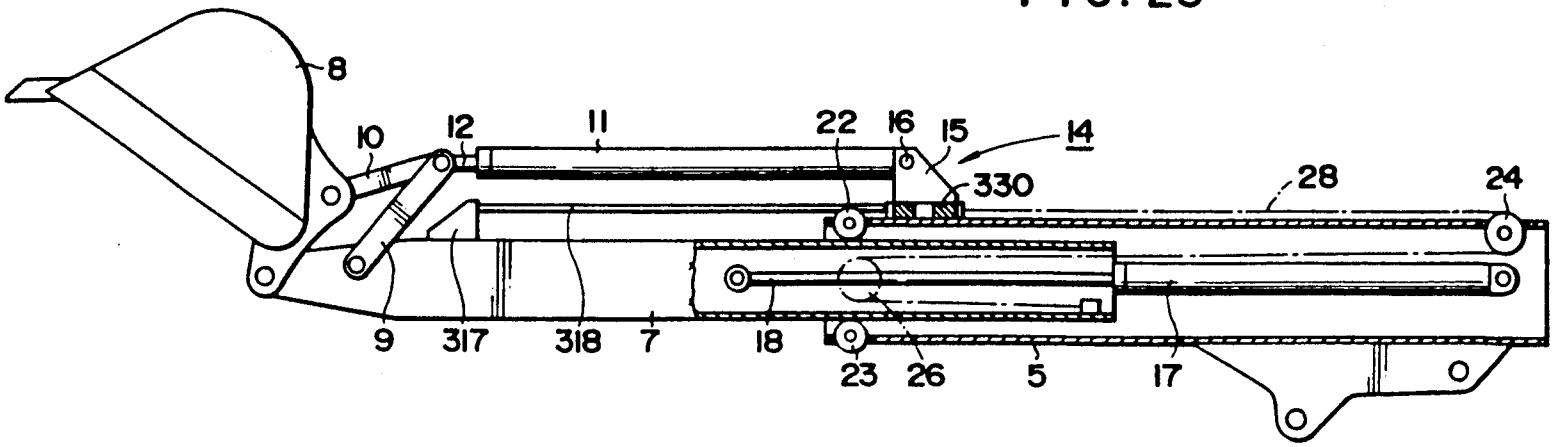
FIG. 26 is a side cross sectional view of assistance in explaining a state where the inner arm is stretched in maximum from the outer arm from the state of FIG. 25.

When the trenches or the holes are to be deepened, the bucket 8 is controlled to be moved to the deeper position. At this time, the third hydraulic cylinder 17 receives the oil under pressure and pushes the piston rod 18 and the inner arm 7 forwardly. The piston rod 18 is extended from the third hydraulic cylinder 17 for thereby pushing the inner arm 7 out of the outer arm 5, hence the inner arm 7 is slid from the position as illustrated in FIG. 25 to the position as illustrated in FIG. 26. Accordingly, the bucket 8 is moved to the position which is located far from the base portion of the outer arm 5 so that the bucket 8 will reach the deepest position and dig the earth and sand therein.

At this time when the inner arm 7 is moved away from the outer arm 5, the interlocking bar 318 fixed to the tip end of the inner arm 7 pulls the slider 14 to thereby move the slider 14 on the upper surface of the outer arm 5 in the longitudinal direction thereof. With the movement of the slider 14, the guides 331, 332 fixed to both the sides of the body 330 contact and are guided by both the sides of the outer arm 5, hence the slider 14 is not moved off the upper surface of the outer arm 5. Inasmuch as the interlocking bar 318 is not so extended, as far as it is stretched by the fixing member 317 the slider 14 moves with synchronism with the movement of the inner arm 7 for the same amount of movement of the inner arm 7. When the third hydraulic cylinder 17 is operated to push the inner arm 7 out of the outer arm 5 due to extension of the piston rod 18, the bucket 8 is kept maintained at the same angular distance relative to the inner arm 7 since the bucket cylinder 11 is moved simultaneously with the extension of the piston rod 18 whereby the excavating operation can be made without difficulty.

When the earth and sand dug by the bucket 8 is raised, the third hydraulic cylinder 17 is first operated to pull the piston rod 18. The inner arm 7 is moved into the inner portion of the outer arm 5. Inasmuch as the chains 28, 29 are connected to the rear portion of the inner arm 7, the chains 28, 29 are stretched in the direction of the base of the outer arm 5 and inverted by the sprocket wheels 26, 27 and further inverted by the sprocket wheels 24, 25 and moved for thereby moving the slider 14 in the direction of the base of the outer arm 5.

Accordingly, when the inner arm 7 is moved in the same manner set forth above, the bucket cylinder 11 is synchronized with the inner arm 7 and stretched for the same amount of movement whereby the bucket 8 is moved consequently while the angular distance of the bucket 8 relative to the inner arm 7 is kept same. Hence, the earth and sand so dug is not dropped from the bucket 8. Thereafter, the first and the second hydraulic cylinders 4, 6 and the bucket cylinder 11 are interlocked with each other so that the earth and sand dug by the bucket 8 is loaded on a track which is standby at the rear side of the movable body 1 or moved and shifted to another portion.

Figure 27:
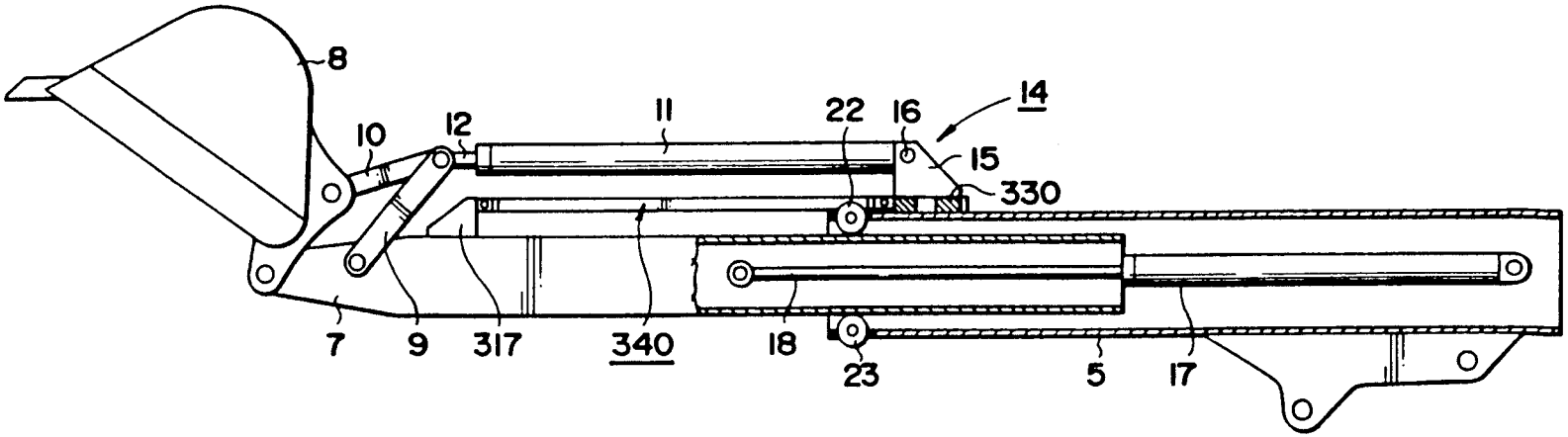
FIG. 27 is a side view partly cut away an outer arm, a constituent of an excavator according to a seventh embodiment of the present invention.
Figure 28:
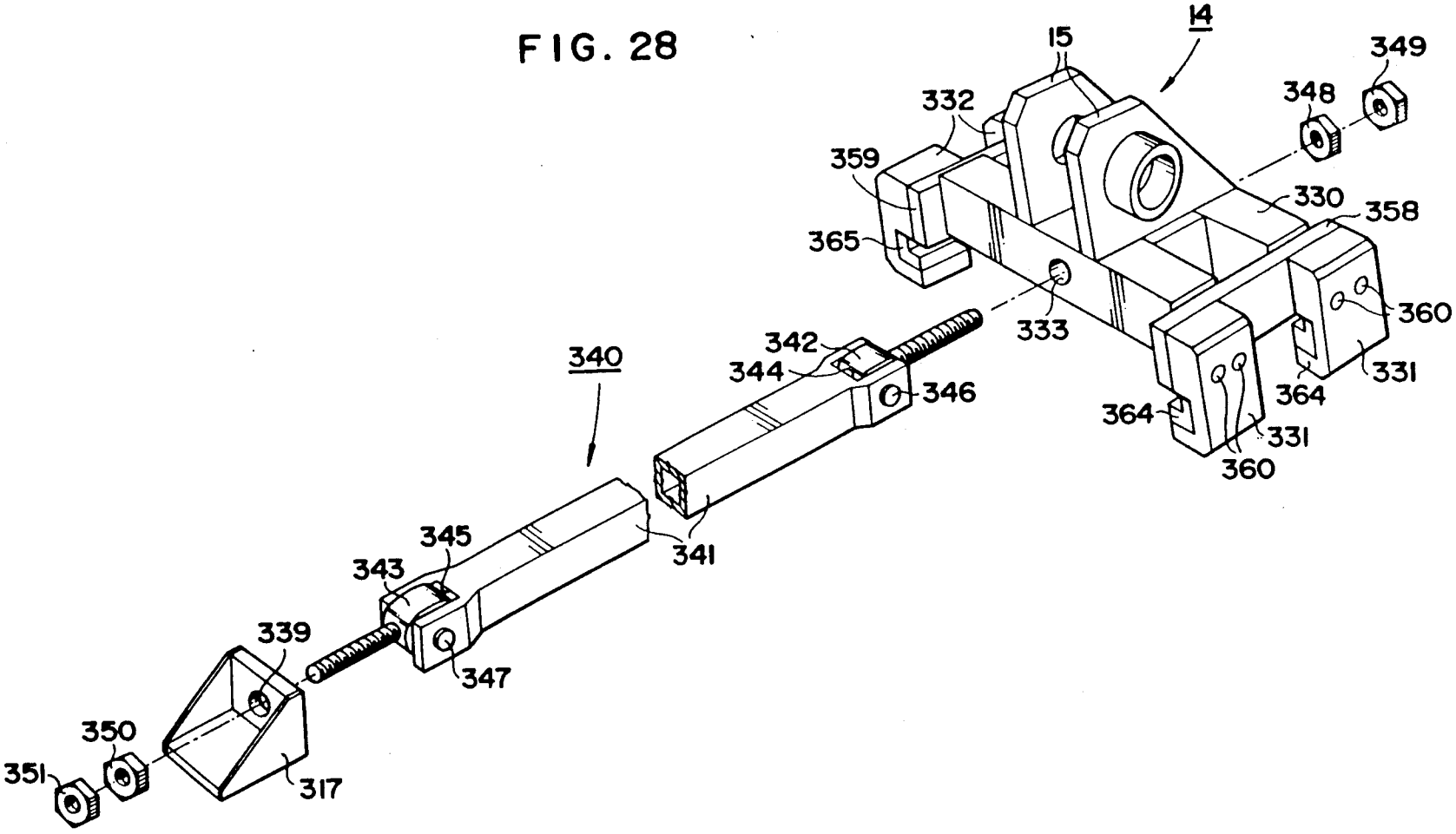
FIG. 28 is an exploded perspective view of a synchronous mechanism of FIG. 27.

Seventh Embodiment (FIGS. 27 to 28)

An excavator having a modified synchronous mechanism according to a seventh embodiment will be described with reference to FIGS. 27 to 28.

A fixing member 317 having a substantially triangular shape is fixed to the inner arm 7 close to the lever 9 and is connected to the body 330 of the slider 14 by a connecting body 340 having a square shape in cross section. The interlocking mechanism has no wires connected to the rear portion of the slider 14.

The connecting body 340 comprises a rod 341 and fixing bolts 342, 343 connected to both ends of the rod 341. The rod 341 is hollow, square shaped in cross section and has inserting grooves 344, 345 at both ends thereof. The fixing bolt 342 is inserted into and connected by a pin 346 to the inserting groove 344. The fixing bolt 343 is inserted into and connected by a pin 347 to the inserting groove 345.

The threaded portion of the fixing bolt 342 is inserted into the connecting hole 333 and screwed in double by fixing nuts 348, 349 so that the fixing bolt 342 is fixed firmly to the body 330 by the fixing nuts 348, 349. The threaded portion of the fixing bolt 343 is inserted into the fixing hole 339 of the fixing member 317 and screwed in double by two nuts 350, 351 at the rear portion of the fixing member 317 so that the fixing bolt 343 is firmly fixed to the fixing member 317 by the fixing bolt 343. With such an arrangement, the rod 341 is swingable vertically by the pins 346, 347 but is not extended or contracted in the longitudinal direction thereof. That is, the rod 341 is formed as a rigid structure unable to be extended or contracted in the longitudinal direction thereof.

When the third hydraulic cylinder 17 is operated to push the piston rod 18 out of the third hydraulic cylinder 17, the rod 341 is pulled by the fixing member 317 and the body 330 of the slider 14 is also pulled so that the base of the bucket cylinder 11 is moved with the angle of the bucket 8 relative to the inner arm 7 being not varied. When the third hydraulic cylinder 17 is operated to contract the piston rod 18, the inner arm 7 connected to the piston rod 18 is drawn inside the outer arm 5. Since the rod 341 fixed to the fixing member 317 is rigid, the rod 341 pushes the body 330 while the length of the rod 341 is not contracted whereby the base of the bucket cylinder 11 is pushed upward toward the rear portion of the outer arm 5. Accordingly, it is possible to move the base of the bucket cylinder 11 with synchronism with the movement of the inner arm 7 while the bucket is kept in the same angular position relative to the inner arm 7. That is, the bucket cylinder 11 can be moved as if the ordinary bucket 8 can be operated.

Differing from the sixth embodiment of the present invention, the excavator according to the present invention reduces parts of the constituents thereof and is simplified.

The excavator according to the sixth and the seventh embodiments has the same advantages as those according to the first to the second embodiments.

Although the invention has been described in its preferred form with a certain degree of particularity, it is to be understood that many variations and changes are possible in the invention without departing from the scope thereof.

What is claimed is:

1. An excavator comprising:

a movable body;

a boom pivotally mounted at a rear end thereof on a front portion of the movable body;

first hydraulic cylinder means mounted at a rear end thereof on the front portion of the movable body, the first hydraulic cylinder means being provided with cylinder rod means connected at a front end thereof with substantially the central portion of the boom for swinging the boom vertically in a longitudinal direction thereof;

an outer arm pivotally swingably mounted on a front end of the boom, said outer arm having a rear end and a front end which extends forwardly from the boom;

a second hydraulic cylinder mounted on a rear surface of the boom, the second hydraulic cylinder being provided with a piston rod connected to a rear portion of the outer arm for changing the angular relationship between the boom and the outer arm;

an inner arm inserted into the outer arm and movable telescopically relative to the outer arm in the longitudinal direction of the outer arm, said inner arm having a rear end located inside the outer arm and a front end extending forwardly from the outer arm;

a bucket pivotally connected to the front end of the inner arm;

a bucket cylinder provided with a piston rod and having a front end operatively connected to the bucket;

guide means fixed to the outer arm;

a guide mechanism slidably mounted on the guide means, said guide mechanism having a front end and a rear end, said guide mechanism being connected to a rear end of the bucket cylinder for sliding the bucket cylinder to thereby move the bucket cylinder and its piston rod as a unit in synchronism with the movement of the inner arm so that the angular relationship between the bucket and the inner arm is kept unchanged;

a third hydraulic cylinder connected to the rear end of the outer arm and having a rod connected to a central portion of the inner arm for moving the inner arm telescopically relative to the outer arm; and synchronous means for moving the bucket cylinder relative to the outer arm for a distance corresponding to the distance the inner arm moves relative to the outer arm, said synchronous means comprising a wheel supported at the front end of the outer arm, a first sprocket wheel supported at the rear end of the outer arm, a second sprocket wheel supported at the rear end of the outer arm, a third sprocket wheel supported at the rear end of the outer arm, a third sprocket wheel supported by the outer arm inside the outer arm and outside the inner arm, a first chain connected to the guide mechanism at the front end thereof and to the rear end of the inner arm, a second chain connected to the rear end of the inner arm and to the guide mechanism at the rear end thereof, the first chain being inverted by the wheel and then extending through a space between the outer arm and the inner arm, and being further inverted by the first sprocket wheel, the second chain being inverted by the second sprocket wheel and then extending through the space between the outer arm and the inner arm and extending in the direction of the bucket, and said second chain being further inverted by the third sprocket wheel.

2. An excavator as claimed in claim 1, further comprising a linkage comprising a first lever having an outer end connected to the front end of the inner arm, a second lever having an outer end connected at a rear portion of the bucket, the first and second levers extending at an angle to each other and being pivotally connected at inner ends thereof to provide an apex thereat, the piston rod of the bucket cylinder being connected to the apex of the linkage.

3. An excavator as claim in claim 1 wherein the guide mechanism comprises a slider, a pair of trapezoidal shaft supporting plates fixed to the slider and being spaced apart a predetermined distance, a base of the bucket cylinder being inserted between the pair of shaft supporting plates and a pin pivotally connecting the base of the bucket cylinder to the pair of shaft supporting plates.

4. An excavator as claimed in claim 1, further comprising a hook mechanism mounted at the front end of the inner arm, the hook mechanism comprising a hoist fixed to the guide mechanism, a first pulley mounted close to the front end of the outer arm, a second pulley mounted inside the outer arm at the rear end thereof, a third pulley supported at the front end of the inner arm, a hook body having a hook attached t the lower portion thereof, a hook receiver attached to the front end of the inner arm for hooking the hook, and a cable which extends from the hoist, is inverted by the first pulley and then is guided along the outer arm through the space between the outer arm and the inner arm, said cable then being further inverted by the second pulley and guided through the inner central portion of the inner arm and then directed downwardly by the third pulley.

5. An excavator comprising:

a movable body;

a boom pivotally mounted at a rear end thereof on a front portion of the movable body;

first hydraulic cylinder means mounted at a rear end thereof on the front portion of the movable body, the first hydraulic cylinder means being provided with cylinder rod means connected at a front end thereof with substantially the central portion of the boom for swinging the boom vertically in a longitudinal direction thereof;

an outer arm pivotally swingably mounted on a front end of the boom, said outer arm having a rear end and a front end which extends forwardly from the boom;

a second hydraulic cylinder mounted on a rear surface of the boom, the second hydraulic cylinder being provided with a piston rod connected to a rear portion of the outer arm for changing the angular relationship between the boom and the outer arm;

an inner arm inserted into the outer arm and movable telescopically relative to the outer arm in the longitudinal direction of the outer arm, said inner arm having a rear end located inside the outer arm and a front end extending frontwardly from the outer arm;

a bucket pivotally connected to the front end of the inner arm;

a bucket cylinder provided with a piston rod and having a front end operatively connected to the bucket;

guide means fixed to the outer arm;

a guide mechanism slidably mounted on the guide means, said guide mechanism having a front end and a rear end, said guide mechanism being connected to a rear end of the bucket cylinder for sliding the bucket cylinder to thereby move the bucket cylinder and its piston rod as a unit in synchronism with the movement of the inner arm so that the angular relationship between the bucket and the inner arm is kept unchanged;

a third hydraulic cylinder connected to the rear end of the outer arm and having a rod connected to a central portion of the inner arm for moving the inner arm telescopically relative to the outer arm;

synchronous means for moving the bucket cylinder relative to the outer arm for a distance corresponding to the distance the inner arm moves relative to the outer arm; and a hook mechanism mounted at the front end of the inner arm, the hook mechanism comprising a hoist fixed to the guide mechanism, a first pulley mounted close to the front end of the outer arm, a second pulley mounted inside the outer arm at the rear end thereof, a third pulley supported at the front end of the inner arm, a hook body having a hook attached to the lower portion thereof, a hook receiver attached to the front end of the inner arm for hooking the hook, and a cable which extends from the hoist, is inverted by the first pulley and then is guided along the outer arm through the space between the outer arm and the inner arm, said cable then being further inverted by the second pulley and guided through the inner central portion of the inner arm and then directed downwardly by the third pulley.

6. An excavator comprising:

a movable body;

a boom pivotally mounted at a rear end thereof on a front portion of the movable body;

first hydraulic cylinder means mounted at a rear end thereof on the front portion of the movable body, the first hydraulic cylinder means being provided with cylinder rod means connected at a front end thereof with substantially the central portion of the boom for swinging the boom vertically in a longitudinal direction thereof;

an outer arm pivotally swingably mounted on a front end of the boom, said outer arm having a rear end and a front end which extends forwardly from the boom;

a second hydraulic cylinder mounted on a rear surface of the boom, the second hydraulic cylinder being provided with a piston rod connected to a rear portion of the outer arm for changing the angular relationship between the boom and the outer arm;

an inner arm inserted into the outer arm and movable telescopically relative to the outer arm in the longitudinal direction of the outer arm, said inner arm having a rear end located inside the outer arm and a front end extending forwardly from the outer arm;

a bucket pivotally connected to the front end of the inner arm;

a bucket cylinder provided with a piston rod and having a front end operatively connected to the bucket;

guide means fixed to the outer arm;

a guide mechanism slidably mounted on the guide means, said guide mechanism having a front end and a rear end, said guide mechanism being connected to a rear end of the bucket cylinder for sliding the bucket cylinder to thereby move the bucket cylinder and its piston rod as a unit in synchronism with the movement of the inner arm so that the angular relationship between the bucket and the inner arm is kept unchanged;

a third hydraulic cylinder connected to the rear end of the outer arm and having a rod connected to a central portion of the inner arm for moving the inner arm telescopically relative to the outer arm;

synchronous means for moving the bucket cylinder relative to the outer arm for a distance corresponding to the distance the inner arm moves relative to the outer arm, said synchronous means comprising a wheel supported at the front end of the outer arm, a first sprocket wheel supported at the rear end of the outer arm, a second sprocket wheel supported at the rear end of the outer arm, a third sprocket wheel supported by the outer arm inside the outer arm and outside the inner arm, a first chain connected to the guide mechanism at the front end thereof and to the rear end of the inner arm, a second chain connected to the rear end of the inner arm and to the guide mechanism at the rear end thereof, the first chain being inverted by the wheel and then extending through a space between the outer arm and the inner arm, and being further inverted by the first sprocket wheel, the second chain being inverted by the second sprocket wheel and then extending through the space between the outer arm and the inner arm and extending in the direction of the bucket, and said second chain being further inverted by the third sprocket wheel; and a hook mechanism mounted at the front end of the inner arm.

7. An excavator as claim in claim 6, further comprising a linkage comprising a first lever having an outer end connected to the front end of the inner arm, a second lever having an outer end connected at a rear portion of the bucket, the first and second levers extending at an angle to each other and being pivotally connected at inner ends thereof to provide an apex thereat, the piston rod of the bucket cylinder being connected to the apex of the linkage.

8. An excavator as claimed in claim 6 wherein the guide mechanism comprises a slider, a pair of trapezoidal shaft supporting plates fixed to the slider and being spaced apart a predetermined distance, a base of the bucket cylinder being inserted between the pair of shaft supporting plates and a pin pivotally connecting the base of the bucket cylinder to the pair of shaft supporting plates.

* * * * *

UNITED STATES PATENT AND TRADEMARK OFFICE

CERTIFICATE OF CORRECTION

PATENT NO. : 5 092 733

DATED : March 3, 1992

INVENTOR(S) : Mitsuhiro Kishi

It is certified that error appears in the above-identified patent and that said Letters Patent is hereby corrected as shown below:

Column 18, line 13; delete "third sprocket".
line 14; delete in its entirety.
line 56; change "t the" to ---to the---.

Signed and Sealed this

Nineteenth Day of October, 1993

*Attest:*

Bruce Lehman

BRUCE LEHMAN

*Attesting Officer*

*Commissioner of Patents and Trademarks*